US008059492B2

(12) United States Patent
Watanabe

(10) Patent No.: US 8,059,492 B2
(45) Date of Patent: Nov. 15, 2011

(54) CALENDAR MECHANISM-ATTACHED TIMEPIECE HAVING MONTH INDICATOR AND DATE INDICATOR

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 525 days.

(21) Appl. No.: 12/313,471

(22) Filed: Nov. 20, 2008

(65) Prior Publication Data

US 2009/0129207 A1 May 21, 2009

(30) Foreign Application Priority Data

Nov. 21, 2007 (JP) ..... 2007-301968

(51) Int. Cl.
*G04B 19/24* (2006.01)

(52) U.S. Cl. ..... 368/37

(58) Field of Classification Search ..... 368/28, 368/35–38

See application file for complete search history.

(56) References Cited

U.S. PATENT DOCUMENTS 3,673,789 A * 7/1972 Tsuzuki et al. ..... 368/37
3,716,983 A * 2/1973 Tanaka et al. ..... 368/28
3,827,234 A * 8/1974 Imanishi ..... 368/38
4,228,644 A * 10/1980 Watanabe et al. ..... 368/28
6,108,278 A * 8/2000 Rochat ..... 368/28
2006/0120219 A1 6/2006 Ruefenacht ..... 368/37

OTHER PUBLICATIONS

Patent Abstracts of Japan, Publication No. JP2005195370, Publication Date, Jul. 21, 2005.
Patent Abstracts of Japan, Publication No. JP54073667, Publication Date, Jun. 13, 1979.
Patent Abstracts of Japan, Publication No. JP2006162611, Publication Date, Jun. 22, 2006.
Patent Abstracts of Japan, Publication No. JP63313089, Publication Date, Dec. 21, 1988.

* cited by examiner

*Primary Examiner* — Vit Miska
(74) *Attorney, Agent, or Firm* — Adams & Wilks

(57) ABSTRACT

To provide a calendar mechanism-attached timepiece having a thin date feeding mechanism and month feeding mechanism. A calendar mechanism-attached timepiece of the invention includes a date indicator, a month indicator, a date indicator driving wheel, a date feed finger, and a small month end feed lever. The date indicator includes a month feed tooth for rotating an intermediate month wheel and a small month end feed tooth for feeding the date indicator at a month end of a small month. The month indicator includes a month cam for operating a small month end feed lever at a month end of a small month. The small month end feed lever is constituted to be able to feed the date indicator by an amount of 1 day based on rotation of the date indicator driving wheel and rotation of the month cam.

6 Claims, 21 Drawing Sheets

CALENDAR MECHANISM-ATTACHED TIMEPIECE HAVING MONTH INDICATOR AND DATE INDICATOR

BACKGROUND OF THE INVENTION

1. Field of the Invention

The present invention relates to a calendar mechanism-attached timepiece having a month indicator and a date indicator. Particularly, the invention relates to a calendar mechanism-attached timepiece having a month indicator and a date indicator constituted such that a month is indicated by a month indicator arranged on an inner side of a timepiece, a date is indicated by a date indicator arranged on an outer side of the month indicator, and it is not necessary to correct an indication of the date indicator at an end of a month other than February.

2. Description of the Related Art

Generally, a machine body including a drive portion of a timepiece is referred to as 'movement'. A state in which the movement is attached with a dial, hands and put into a timepiece case to constitute a finished product is referred to as 'complete' of the timepiece. A side of both sides of a main plate constituting a base plate of a timepiece having a glass of a timepiece case, that is, a side having a dial is referred to as 'back side' or 'glass side' or 'dial side' of the movement. A side of both sides of the main plate having a case back of a timepiece case, that is, a side opposed to the dial is referred to as 'top side' or 'case back side' of the movement. A train wheel integrated to 'top side' of the movement is referred to as 'top train wheel'. A train wheel integrated to 'back side' of the movement is referred to as 'back train wheel'.

Generally, '12 o'clock side' indicates a side for arranging a graduation in correspondence with 12 o'clock of the dial in an analog type timepiece. '12 o'clock direction' indicates a direction directed from a rotation center of an indicator to '12 o'clock side' in the analog type timepiece. Further, '3 o'clock side' indicates a side of arranging a graduation in correspondence with 3 o'clock of the dial in the analog type timepiece. '3 o'clock direction' indicates a direction directed from the rotation center of the indicator to '3 o'clock side' in the analog type timepiece. Further, '6 o'clock side' indicates a side of arranging a graduation in correspondence with 6 o'clock of the dial in the analog type timepiece. '6 o'clock direction' indicates a direction directed from the rotational center of the indicator to '6 o'clock side' in the analog type timepiece. Further, '9 o'clock side' indicates a side of arranging a graduation in correspondence with 9 o'clock of the dial in the analog type timepiece. '9 o'clock direction' indicates a direction directed from the rotational center of the indicator to '9 o'clock side' in the analog type timepiece. Further, there is a case of indicating a side of arranging other graduation of the dial as in '2 o'clock direction', '2 o'clock side'.

According to a calendar mechanism-attached timepiece of a first type of a background art, a 1-th date recess portion for detecting 1-th date of a date plate, and a 30-th date recess portion for detecting 30-th date of the date plate are formed at the same step layer on an inner diameter of the date plate in a direction of a rotating shaft of a date indicator driving wheel. A date feed finger and a month feed finger are provided at the date indicator driving wheel. 1-th date is detected by a 1-th date detecting portion of a 1-th date detecting lever, the month feed finger is controlled by a month feed restricting portion of a month feed control apparatus and a month is not fed by other than 1-th date. When 1-th date is reached, the month plate is fed by the month feed finger. In a case of a large month, the date plate is made to be fed by only 1 date by the date feed finger by restricting the date feed finger by a small month detecting lever. In a case of a small month, the small month detecting lever is made to be able to be rotated in the counterclockwise direction and two teeth of the date plate are made to be fed successively by the date feed finger. A 30-th date detecting lever detects 30-th date by being engaged with the 30-th date recess portion, and only when the small month detecting lever simultaneously detects a small month, the teeth of the date plate are made to be fed by 2 teeth by the date feed finger (refer to, for example, Japanese Patent Publication No. 2651150).

According to a calendar mechanism-attached timepiece of a second type of a background art, a tooth portion with which a date feed finger is brought into contact, a 30-th date recess portion for detecting 30-th date of a date plate, and a 1-th date recess portion for detecting 1-th date of the date plate are formed in steps at step layers different from each other on an inner diameter of the date plate in a direction of a rotating shaft of a date indicator driving wheel (refer to, for example, JP-A-2005-195370).

A calendar mechanism-attached timepiece of a third type of a background art is constituted such that a notched portion is provided at a date indicating member, and a month is indicated by the notched portion only when the date indicating member is disposed at a specific position (refer to, for example, JP-A-54-73667).

A calendar mechanism-attached timepiece of a fourth type of a background art includes a date drive wheel set, a year wheel includes 24 sheets of teeth twice as much as a number of months of one year, an intermediate wheel includes a first wheel brought in mesh with the year wheel and a second wheel arranged to be fixed coaxially with the first wheel, and the second wheel is constituted to be brought in mesh with a projection aligned on an inner side of a second stage of a date ring (refer to, for example, JP-A-2006-162611).

According to the calendar mechanism-attached timepiece of the first type of the background art, the 1-th date recess portion of the date plate, and the 30-th date recess portion of the date plate are formed at the same step layer, and the 30-th date detecting portion detects also the both recess portions of the date plate to pose a problem that an operation of the calendar mechanism becomes unstable. Further, according to the constitution, three control levers, that is, the 1-th date detecting lever, the small month detecting lever and the 30-th date detecting lever are arranged between the date plate and the month plate, and therefore, a problem that a structure of the calendar mechanism is complicated and downsizing of the timepiece is difficult is posed.

According to the calendar mechanism-attached timepiece of the second type of the background art, the 30-th date recess portion of the date plate engaged with the 30-th date detecting lever and the 1-th date recess portion of the date plate engaged with the 1-th date detecting lever are formed at different step layers in a thickness direction of the movement, and therefore, a problem that a thickness of the movement is thickened by increasing a thickness of the date plate.

According to the calendar mechanism-attached timepiece of the third type of the background art, a month is indicated by the notched portion of the date indicating member, and therefore, a problem that month indication is small and difficult to be viewed is posed. Further, according to the structure, a problem that month indication can be viewed only at a specific date is posed.

According to the calendar mechanism-attached timepiece of the fourth type of the background art, a problem that a structure of the date drive wheel set is complicated and the timepiece is difficult to be downsized is posed. Further, according to the structure, a problem that month indication is small and difficult to be viewed is posed.

SUMMARY OF THE INVENTION

It is an aspect of the invention to provide a calendar mechanism-attached timepiece in which a date feed mechanism and a month feed mechanism are constituted to be thin and small-sized and a thickness of a movement is thin.

It is another aspect of the invention to provide a calendar mechanism-attached timepiece in which structures of a date feed mechanism and a month feed mechanism are simple and operation is stabilized.

It is another aspect of the invention to provide an automatic calendar mechanism-attached timepiece constituted by a structure in which a month indication is large and easy to be viewed and it is not necessary to correct an indication of a date indicator at an end of a month other than February.

The invention includes a date indicator for indicating a date, a month indicator for indicating a month by being rotated based on rotation of the date indicator, a date indicator driving wheel constituted to rotate by one rotation per 24 hours, a date feed finger constituted to be able to rotate the date indicator based on rotation of the date indicator driving wheel, and a small month end feed lever constituted to be able to rotate the date indicator based on rotation of the date indicator driving wheel and rotation of the month indicator in a calendar mechanism-attached timepiece having the month indicator and the date indicator. The date indicator is constituted to include a date indicating face portion provided with a date character, a date indicator tooth portion brought into contact with a date feed portion of the date feed finger, a month feed tooth for rotating an intermediate month wheel, and a small month end feed tooth for feeding the date indicator at an end of a small month. The month indicator is constituted to include a month indicating face portion provided with a month character, and a month cam for operating a small month end feed lever at the end of the small month. The small month end feed tooth of the date indicator is arranged to be able to be brought into contact with the small month end feed lever when an indication by the date character is an end of a month. The small month end feed lever is constituted to be able to feed the date indicator by an amount of one day based on rotation of the date indicator driving wheel and rotation of the month cam at the end of the small month. By the constitution, the calendar mechanism-attached timepiece stabilizing operations of a date feed mechanism and a month feed mechanism can be realized. Further, by the constitution, a constitution of preventing an extraneous load from being applied on a transmission train wheel in normally feeding a date can be constructed.

It is preferable that the calendar mechanism-attached timepiece of the invention further includes an intermediate month wheel constituted to be able to rotate the month indicator by being rotated based on rotation of the date indicator, wherein the intermediate month wheel is constituted to be able to feed the month indicator at the end of the month. By the constitution, the calendar mechanism-attached timepiece stabilizing operations of the date feed mechanism and the month feed mechanism can be realized.

It is preferable to constitute the calendar mechanism-attached timepiece of the invention such that the small month end feed lever includes a small month end feed finger for feeding the date indicator at the end of the small month, the small month end feed tooth is provided to detect time at which the indication of the date indicator is '30-th date', the small month end feed tooth is provided at an inner side wall portion of the date indicator, and the small month end feed tooth of the date indicator is arranged to be able to be brought into contact with the small month end feed finger when the indication by the date character is the end of the month. By the constitution, the calendar mechanism-attached timepiece stabilizing operations of the date feed mechanism and the month feed mechanism can be realized.

According to the calendar mechanism-attached timepiece of the invention, it is preferable to constitute such that the small month end feed lever is arranged on an upper side of the date indicator driving wheel and is made to be able to move relative to a rotation center of the date indicator driving wheel. By the constitution, the calendar mechanism-attached timepiece having a thin thickness of a movement can be realized.

According to the calendar mechanism-attached timepiece of the invention, it is preferable to constitute such that the small month end feed tooth is arranged on a side more proximate to the date indicator tooth portion than the date indicating face portion. By the constitution, the calendar mechanism-attached timepiece having the thin thickness of the movement can be realized.

According to the calendar mechanism-attached timepiece of the invention, it is preferable to constitute such that the date indicator driving wheel includes a lever drive pin, and the small month end feed lever is rotated by the lever drive pin and is made to be able to move relative to the small month end feed tooth based on rotation of the month indicator. By the constitution, the calendar mechanism-attached timepiece stabilizing operations of the date feed mechanism and the month feed mechanism can be realized.

Next, an operation in a typical indicating state will be explained in the calendar mechanism-attached timepiece of the invention. According to the calendar mechanism-attached timepiece of the invention, in a state of indicating '30-th date' of 'large month', the indication of month is 'OCT' in correspondence with 'October'. When the date indicator driving wheel is rotated, the date feed portion of the date feed finger is brought into contact with one tooth of the date indicator, and the small month end feed cam of the small month end feed lever is not brought into contact with the month cam of a month star wheel. When the date indicator driving wheel is rotated further, the date feed finger is rotated further, and feeds the date indicator by one tooth in the counterclockwise direction. On the other hand, the month feed tooth of the date indicator is not brought into contact with the tooth portion of the intermediate month wheel. Therefore, the date feed finger feeds the date indicator by one tooth in the counterclockwise direction and indication of the date is changed to '31-th date'. The month feed tooth of the date indicator is not brought into contact with the tooth portion of the intermediate month wheel, and therefore, when the state is changed from a state of indicating '30-th date' of 'large month' to a state indicating '31-th date', the month feeding is not carried out, and therefore, the indication of month is not changed but stays to be 'OCT'. An operation in 'large month' other than 'October' is similar to the operation of 'October'.

Further, according to the calendar mechanism-attached timepiece of the invention, in a state of indicating '30-th date' of 'small month', and in a state in which the indication of month is 'NOV' in correspondence with 'November', 'small month' is detected based on rotation of the date indicator, at the same time, '30-th date' is detected. The small month end feed finger of the small month end feed lever feeds the small month end feed tooth of the date indicator, and the month feed tooth of the date indicator is rotated so as not to be brought into contact with the tooth portion of the intermediate month wheel. Further, when the date indicator driving wheel 210 is rotated, indication of date is changed to '31-th date'. When the date indicator driving wheel is rotated further, the date feed finger is rotated further, and the tooth of the date indicator can be fed in the counterclockwise direction by one tooth. On the other hand, the month feed tooth of the date indicator rotates the tooth portion of the intermediate month wheel. By rotation of the intermediate month wheel, a month star wheel tooth portion of the month star wheel can be rotated in the clockwise direction by one tooth. Therefore, indication of date is changed to '1-th date' and indication of month is changed to 'DEC'. The operation at the end of 'small month' other than 'November' is similar to operation at the end of 'November'.

As has been explained above, according to the calendar mechanism-attached timepiece of the invention, in small month, the date is fed at the end of the month by an operation of the small month end feed tooth provided at the date indicator, and the month can be fed by way of the intermediate month wheel by the operation of the month feed tooth provided at the date indicator. Therefore, by the invention, the calendar mechanism-attached timepiece constituted such that an extraneous load is prevented from being applied to a transmission train wheel in normal date feeding can be realized.

According to the calendar mechanism-attached timepiece of the invention, the date feed mechanism and the month feed mechanism are thin and small-sized. Further, according to the calendar mechanism-attached timepiece of the invention, structures of the date feed mechanism and the month feed mechanism are simple and operations thereof are stabilized. Further, the calendar mechanism-attached timepiece of the invention can be constituted such that extraneous load is prevented from being applied to the transmission train wheel in the normal date feeding. Further, according to the calendar mechanism-attached timepiece of the invention, the month indication is large and easy to be viewed and it is not necessary to correct indication of the date indicator at the end of the month other than February.

DETAILED DESCRIPTION OF THE PREFERRED EMBODIMENTS

Figure 1:
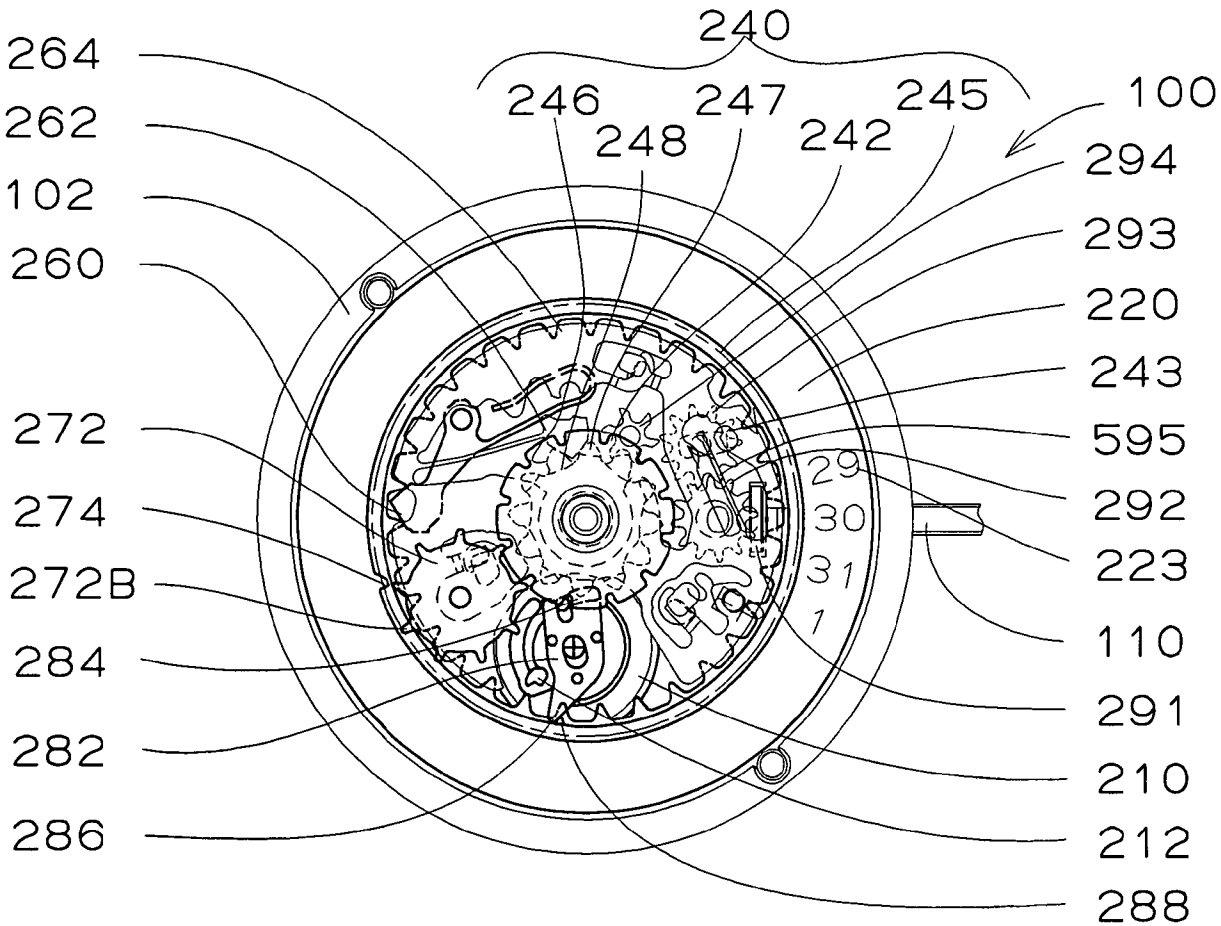
FIG. 1 is an outline plane view showing a structure when a movement is viewed from a side of a dial according to an embodiment of a calendar mechanism-attached timepiece of the invention.
Figure 2:
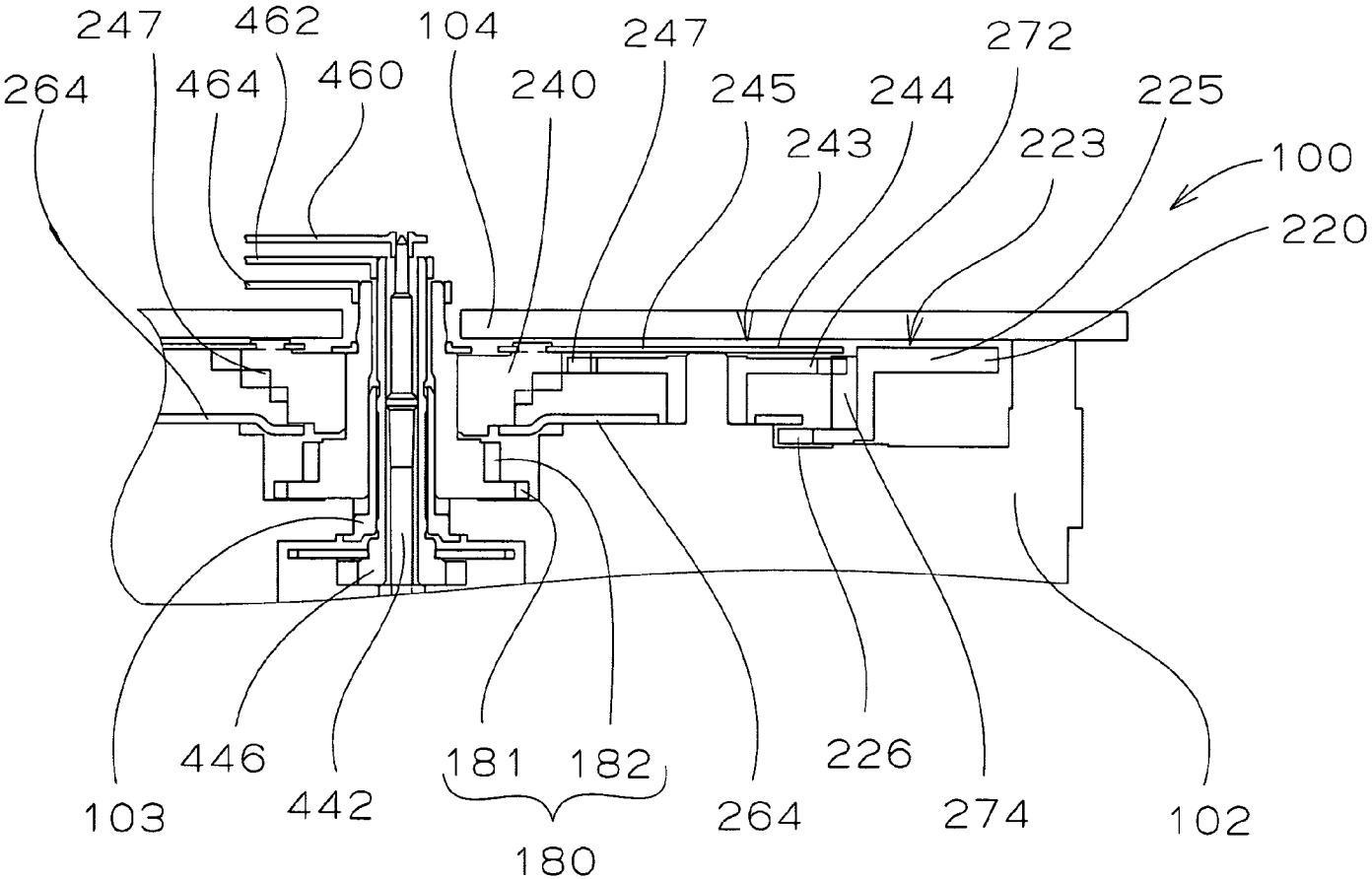
FIG. 2 is a partial sectional view showing an hour wheel, a month feeding mechanism, an intermediate month wheel and the like according to the embodiment of the calendar mechanism-attached timepiece of the invention.
Figure 3:
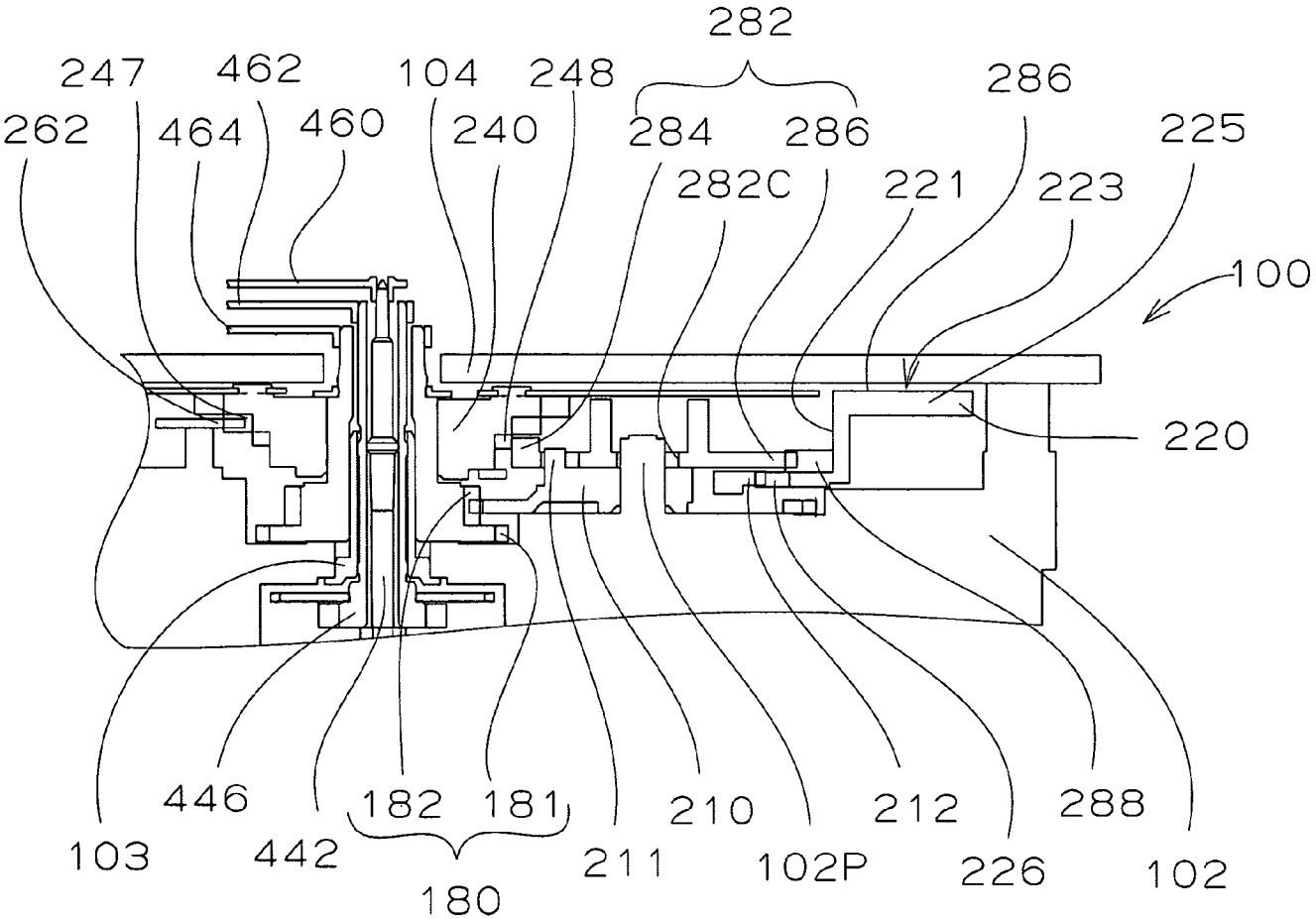
FIG. 3 is a partial sectional view showing the hour wheel, a date feeding mechanism, a small month end feed lever and the like according to the embodiment of the calendar mechanism-attached timepiece of the invention.

An embodiment of a calendar mechanism-attached timepiece of the invention will be explained in reference to the drawings as follows. An embodiment of the invention explained below is an embodiment when a calendar mechanism-attached timepiece is constituted by an analog electronic timepiece. Although in the following explanation, an explanation is given of a constitution of applying the calendar mechanism-attached timepiece of the invention to an analog electronic timepiece, the calendar mechanism-attached timepiece of the invention is applicable not only to an analog electronic timepiece but to a mechanical timepiece. That is, a concept of 'calendar mechanism-attached timepiece' of the specification is a concept including 'analog electronic timepiece', 'mechanical timepiece', and analog timepieces of all other operation principles.

(1) Total Constitution of Movement:

In reference to FIG. 1 through FIG. 4 and FIG. 20, a movement 100 is constituted by an analog electronic timepiece. The movement 100 includes a main plate 102 constituting a base plate of the movement 100. A dial 104 is attached to a glass side of the movement 100. A hand setting stem 110 is rotatably integrated to the main plate 102. A switching apparatus • a setting apparatus include the hand setting stem 110, a train wheel setting lever 468, and a hand setting stem positioning portion 663 of a battery connection (+) 662.

(2) Constitution of Top Side of Movement

Next, a constitution of a top side of the movement will be explained. In reference to FIG. 2 through FIG. 4 and FIG. 20, in the movement 100, a battery 440 constituting a power source of the timepieces is arranged on a case back side (top side) of the main plate 102. It is preferable to arrange a center of the battery 440 between '10 o'clock direction' and '2 o'clock direction' in the movement 100. It is further preferable to arrange the center of the battery 440 between '11 o'clock direction' and '1 o'clock direction' in the movement 100. A quartz unit 650 constituting an oscillation source of the timepiece is arranged on the case back side of the main plate 102. A quartz oscillator is contained in the quartz unit 650. A motor drive portion (driver) outputting a motor drive signal to a step motor based on oscillation of the quartz oscillator is included in an integrated circuit (IC) 654.

The quartz unit 650 and the integrated circuit 654 are fixed to a circuit board 610. A circuit block 612 is constituted by the circuit board 610, the quartz unit 650, and the integrated circuit 654. The circuit block 612 is arranged on the case back side of the main plate 102. A battery connection (−) 660 is provided for conducting a minus pattern of the circuit board 610 to a cathode of the battery 440. A battery connection (+) 662 is provided for conducting a plus pattern of the circuit board 610 to an anode of the battery 440. A coil block 630, a stator 632, and a rotor 634 constituting the step motor are arranged on the case back side of the main plate 102.

A fifth wheel & pinion 441 is constituted to be rotated by rotation of the rotor 634. A fourth wheel & pinion 442 is constituted to rotate by rotation of the fifth wheel & pinion 441. A third wheel & pinion 444 is constituted to rotate by rotation of the fourth wheel & pinion 442. A center wheel & pinion 446 is constituted to rotate by rotation of the third wheel & pinion 444. A minute wheel 448 is constituted to rotate by rotation of the center wheel & pinion 446. An hour wheel & pinion 180 is constituted to rotate by a rotation of the minute wheel 448. The hour wheel & pinion 180 includes an hour wheel 181 and a date feed wheel 182. An hour hand 464 is attached to the hour wheel & pinion 180. The hour wheel & pinion 180 is constituted to rotate by one rotation per 12 hours.

The fourth wheel & pinion 442 is constituted to rotate by one rotation per one minute. A second hand 460 is attached to the fourth wheel & pinion 442. The center wheel & pinion 446 is constituted to rotate by one rotation per 1 hour. A minute hand 462 is attached to the center wheel & pinion 446. A slip mechanism is provided at the center wheel & pinion 446. When the hand setting stem 110 is pulled to a second stage to set hands, in order to stop rotating the second hand 460 by setting a wheel portion of the fifth wheel & pinion 441, the train wheel setting lever 468 is provided. A center pipe 103 is fixed to the main plate 102. The center pipe 103 is extended from the case back side of the main plate 102 to the dial side of the main plate 102. A train wheel bridge 158 for rotatably supporting the top train wheel is arranged on the case back side of the main plate 102.

(3) Constitutions of Switching Mechanism, and Setting Mechanism:

Constitutions of the switching mechanism, the hand setting mechanism will be explained as follows. In reference to FIG. 4 and FIG. 20, in the movement 100, the hand setting stem 110 is rotatably integrated to the main plate 102. The hand setting stem 110 includes a front end shaft portion 111, a first angle portion 112, a first shaft portion 113, a setting operation shaft portion 114, a second shaft portion 115, a second angle portion 116, a third shaft portion 117, a first abacus bead portion 118, a second abacus bead portion 119, and a root shaft portion 120 formed successively from a front end side. The front end shaft portion 111 of the hand setting stem 110 is integrated rotatably to a hand setting stem front end hole of the main plate 102. The root shaft portion 120 of the hand setting stem 110 is integrated rotatably to a hand setting stem root hole of the main plate 102. It is preferable that an outer diameter of the first abacus bead portion 118 is constituted to be larger than an outer diameter of the second abacus bead portion 119.

A clutch wheel 472 is arranged to provide a rotation axis line the same as a rotation axis line of the hand setting stem 110. When the hand setting stem 110 is disposed at 0 stage and 1 stage, a cooperatively moving square hole of the clutch wheel 472 is rotatable relative to the first shaft portion 113 of the hand setting stem 110, and the clutch wheel 472 is constituted not to rotate even when the hand setting stem 110 is rotated. When the hand setting stem 110 is disposed at 2 stage, the cooperatively moving square hole of the clutch wheel 472 is fitted to the first angle portion 112 of the hand setting stem 110, and the clutch wheel 472 is constituted to rotate based on rotation of the hand setting stem 110. When the hand setting stem 110 is disposed at 0 stage, the hand setting stem positioning portion 663 of the battery connection (+) 662 is constituted to be disposed between the root shaft portion 120 and the second abacus bead portion 119. When the hand setting stem 110 is disposed at 1 stage, the hand setting stem positioning portion 663 of the battery connection (+) 662 is constituted to be disposed between the first abacus bead portion 118 and the second abacus bead portion 119. When the hand setting stem 110 is disposed at 2 stage, the hand setting stem positioning portion 663 of the battery connection (+) 662 is constituted to be disposed between the first abacus bead portion 118 and the third shaft portion 117. Therefore, according to the switching apparatus of the above-described constitution, by the hand setting stem positioning portion 663 of the battery connection (+) 662, the hand setting stem 110 can be disposed at three axis line direction positions (0 stage, 1 stage, 2 stage).

When the hand setting stem 110 is disposed at 0 stage and when the hand setting stem 110 is disposed at 1 stage, the train wheel setting lever 468 is constituted such that the setting operation shaft portion 114 of the hand setting stem 110 is not brought into contact with the train wheel setting lever 468 and the wheel portion of the fifth wheel & pinion 441 is not set. When the hand setting stem 110 is disposed at 2 stage, the setting operation shaft portion 114 of the hand setting stem 110 is constituted to set the wheel portion of the fifth wheel & pinion 441 by being brought into contact with the train wheel setting lever 468.

Figure 4:
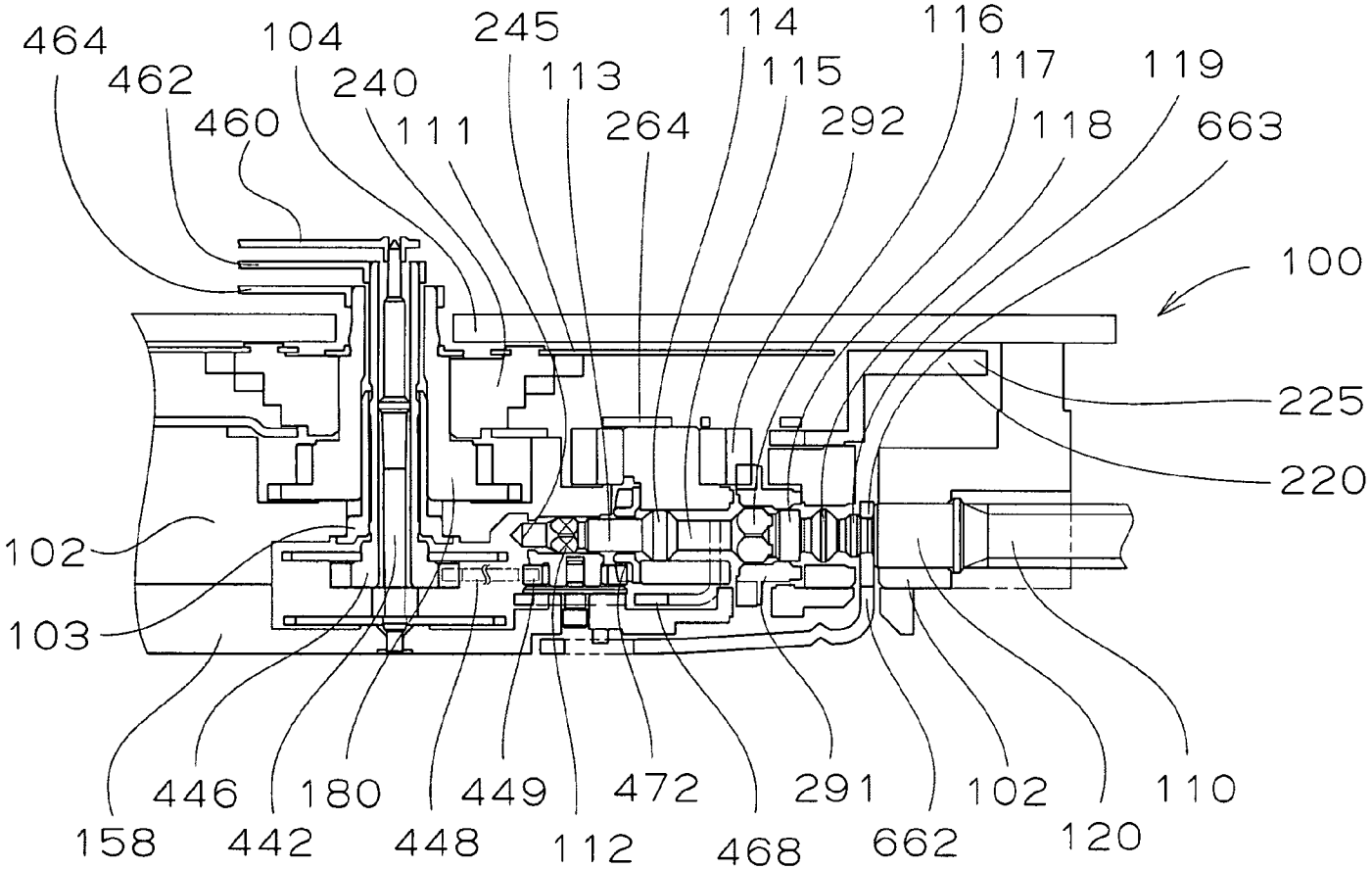
FIG. 4 is a partial sectional view showing a portion from a hand setting stem to the hour wheel according to the embodiment of the calendar mechanism-attached timepiece of the invention.
Figure 5:
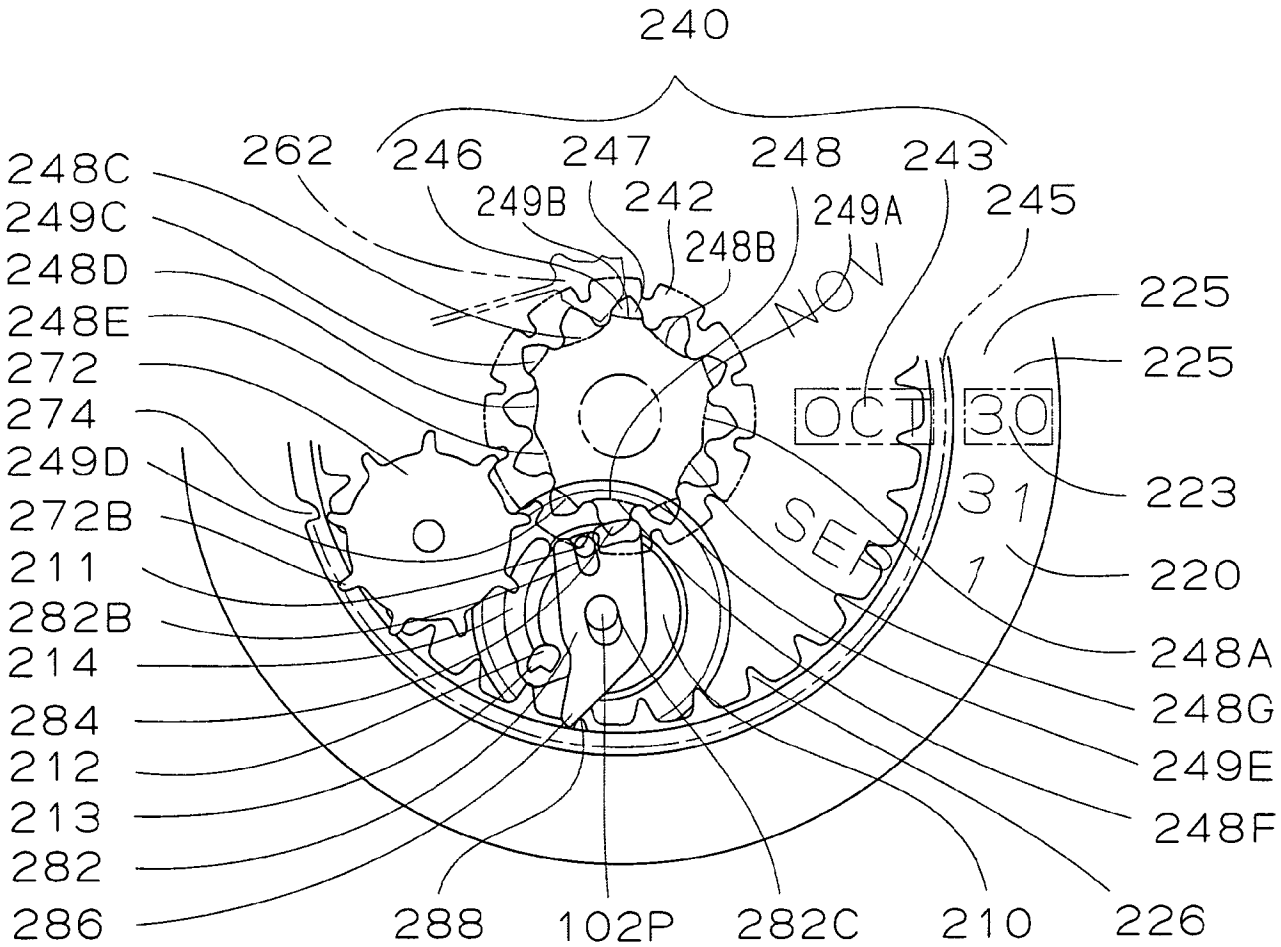
FIG. 5 is a partial plane view (part 1) showing structures of the date feeding mechanism and the month feeding mechanism in a state of changing from October 30 to October 31 according to the embodiment of the calendar mechanism-attached timepiece of the invention.

In reference to FIG. 1 and FIG. 4, a first calendar corrector setting wheel 291 is arranged to provide a rotation axis line the same as the rotation axis line of the hand setting stem 110. When the hand setting stem 110 is disposed at 0 stage, a cooperatively moving round hole of the first calendar corrector setting wheel 291 is rotatable relative to the third shaft portion 117 of the hand setting stem 110, and the first calendar corrector setting wheel 291 is constituted not to rotate even when the hand setting stem 110 is rotated. When the hand setting stem 110 is disposed at 1 stage, the cooperatively moving round hole of the first calendar corrector setting wheel 291 is fitted to the second angle portion 116 of the hand setting stem 110 and the first calendar corrector setting wheel 291 is constituted to rotate based on rotation of the hand setting stem 110. When the hand setting stem 110 is disposed at 2 stage, the cooperatively moving round hole of the first calendar corrector setting wheel 291 is rotatable relative to the second shaft portion 115 of the hand setting stem 110, and the first calendar corrector setting wheel 291 is constituted not to rotate even when the hand setting stem 110 is rotated.

The minute wheel of the minute wheel and pinion 448 is arranged to be brought in mesh with a setting wheel 449. The setting wheel 449 is arranged between the main plate 102 and the train wheel bridge 158. The minute pinion of the minute wheel & pinion 448 is disposed on the dial side of the main plate 102 and is constituted to be brought in mesh with the hour wheel 181 of the hour wheel & pinion 180. The hole portion of the hour wheel & pinion 180 is rotatably supported by an outer peripheral portion of a shaft portion of the center pipe 103.

(4) Constitution of Calendar Mechanism:

Next, a constitution of a calendar mechanism will be explained. FIG. 1 is a plane view showing a structure of a backside of the movement 100 viewed from the dial side in a state of indicating October 30. In reference to FIG. 1 through FIG. 5, the movement 100 includes the date indicator driving wheel 210 rotated by rotation of the hour wheel & pinion 180, the date indicator 220 for indicating a date, a date jumper 260 for setting a position in a direction of rotating the date indicator 220, a month indicator 240 for indicating a month, a month jumper 262 for setting a position in a direction of rotating the month indicator 240, and a date indicator maintaining plate 264 for supporting the date indicator 220 to the main plate 102 rotatably in the counterclockwise direction. The date indicator driving wheel 210 is constituted to rotate in the counterclockwise direction by one rotation per 24 hours. It is preferable to arrange a center of rotation of the date indicator driving wheel 210 between '4 o'clock direction' and '8 o'clock direction' in the movement 100. It is further preferable to arrange the center of rotation of the date indicator driving wheel 210 between '5 o'clock direction' and '7 o'clock direction' in the movement 100. It is preferable to arrange the date indicator driving wheel 210 so as not to overlap the battery 440. It is preferable that a center of rotation of the date indicator 220 is disposed at a position the same as that of the center of rotation of the hour wheel & pinion 180.

The date indicator 220 includes an inner side wall portion 221 facing an inner side of the movement, an outer side wall portion 222 facing an outer side of the movement, a date plate portion 225 including the date indicating face portion 224 provided with the date character 223, and a date indicator tooth portion 226. The date indicator tooth portion 226 includes 31 pieces of inner teeth arranged at equal angular intervals (360/31 degrees). The date character 223 can be constituted by 31 pieces of numerals indicating 'date', etc. (for example, '1', '2', '3', . . . , '29', '30', '31') arranged at equal intervals (360/31 degrees).

The inner side wall portion 221 of the date indicator 220 is arranged on a lower side of the date indicating face portion 224. The inner side wall portion 221 of the date indicator 220 is arranged on a side of a lower face of the date indicator 220, and the date indicator tooth portion 226 is arranged on a side of a lower face of the date indicator 220. A small month end feed tooth 288 for detecting time at which the indication of the date indicator 220 is '30-th date' is provided at the inner side wall portion 221 of the date indicator 220. The small month end feed tooth 288 is formed only at one portion as a projected portion projected to an inner side in a radius direction at the inner side wall portion 221 of the date indicator 220.

A month feed tooth 274 for detecting time at which the indication of the date indicator 220 is '31-th date' is provided at the inner side wall portion 221 of the date indicator 220. The month feed tooth 274 is formed only at one portion as a projected portion projected to the inner side in the radius direction at the inner side wall portion 221 of the date indicator 220. The small month end feed tooth 288 is arranged on a side of being proximate to the date indicator tooth portion 226 more than the date indicating face portion 224. By constituting in this way, a calendar mechanism-attached timepiece stabilizing operation of a date feeding and a month feeding and having a thin thickness of the movement can be realized.

The month indicator 240 includes a month plate 245 including the month indicating face portion 244 provided with the month character 243, a month star wheel 247 including a month star wheel tooth portion 246, and a month cam 248 in correspondence with time at which the indication of the month indicator 240 is 'large month' (that is, 'January' or 'JAN' or the like, 'March' or 'MAR' or the like, 'May' or 'MAY' or the like, 'July' or 'JUL' or the like, 'August' or 'AUG' or the like, 'October' or 'OCT' or the like, 'December' or 'DEC' or the like). The month cam 248 is constituted as recess portions recessed to the inner side in the radius direction at 7 portions of January cam 248A in correspondence with January, March cam 248B in correspondence with March, May cam 248C in correspondence with May, July cam 248D in correspondence with July, August cam 248E in correspondence with August, October cam 248F in correspondence with October, and December cam 248G in correspondence with December. Reference positions of the month cams 248 are arranged such that angular intervals successively become (2*360/12 degrees), (2*360/12 degrees), (2*360/12 degrees), (1*360/12 degrees), (2*360/12 degrees), (2*360/12 degrees), (1*360/12 degrees) in the counterclockwise direction by constituting a reference by the January cam 248A (refer to FIG. 5).

The month star wheel tooth portion 246 includes 12 pieces of outer teeth arranged at equal angular intervals (360/12 degrees). The month character 243 can be constituted by 12 pieces of characters indicating 'month' arranged at equal intervals (360/12 degrees), for example, 'JAN', 'FEB', . . . , 'NOV', 'DEC' or the like). Or, the month character 243 can also be constituted by 12 pieces of numerals, signs, characters, abbreviated characters or pertinent combinations thereof (indication of, for example, '1 month', '2 month', . . . , '11 month', '12 month', or '1 month', '2 month', . . . , '11 month', '12 month' in Chinese letters, or 'Jan', 'Feb', . . . , 'Nov', 'Dec' or the like) arranged at equal angular intervals (360/12 degrees).

A small month detecting cam 249 is provided for detecting time at which indication of the month indicator 240 is 'small month' (that is, 'February', 'April', 'June', 'September', 'November'). The small month detecting cam 249 is constituted at 5 portions as recess portions recessed to the inner side in the radius direction. The small month detecting cam 249 is constituted to include 5 pieces of recess portions of February cam 249A in correspondence with February, April cam 249B in correspondence with April, June cam 249C in correspondence with June, September cam 249D in correspondence with September, and November cam 249E in correspondence with November. A reference position of the small month detecting cam 249 is arranged such that angular intervals successively become (2*360/12 degrees), (2*360/12 degrees), (3*360/12 degrees), (2*360/12 degrees), (3*360/12 degrees) in the clockwise direction by constituting a reference by February cam 249A.

A setting portion of the date jumper 260 is constituted to set the date indicator tooth portion 226. A setting portion of the month jumper 262 is constituted to set the month star wheel tooth portion 246. It is preferable that a center of rotation of the month indicator 240 is disposed at a position the same as that of the center of rotation of the hour wheel & pinion 180. Therefore, it is preferable that the center of rotation of the month indicator 240 is disposed at a position the same as that of the center of rotation of the date indicator 220. The month indicating face portion 244 of the month indicator 240 is arranged on an inner side of the date indicating face portion 224 of the date indicator 220.

A date feed finger 212 for feeding the date indicator tooth portion 226 of the date indicator 220 is provided to be rotated integrally with rotation of the date indicator driving wheel 210. The date feed finger 212 includes a date feed portion 213 arranged at the front end and a date feed finger spring portion 214. A root portion of the date feed finger spring portion 214 is fixed to the date indicator driving wheel 210. By rotation of the date indicator driving wheel 210, the date feed finger 212 is rotated, and by the date feed finger 212, the date indicator 220 is constituted to be able to rotate in the counterclockwise direction by only once per 24 hours intermittently by 360/31 degrees.

The date feed finger 212 is constituted by an elastically deformable material (for example, engineering plastic of polyacetal or the like). The date feed finger 212 can be formed to be integral with the date indicator driving wheel 210. The date feed finger 212 can be constituted to rotate integrally by rotation of the date indicator driving wheel 210 by being formed separately from the date indicator driving wheel 210.

A small month end feed lever 282 is arranged to be able to be operated between the month plate 245 and the date indicator driving wheel 210. The small month end feed lever 282 includes a small month end feed cam 284 arranged to be able to be brought into contact with the month cam 248 of the month indicator 240, a notched portion 282B arranged to be able to be brought into contact with a lever drive pin 211, a small month end feed finger 286 arranged to be able to be brought into contact with the small month end feed tooth 288 of the date indicator 220, and a lever long hole 282C. The small month end feed lever 282 is positioned based on rotation of the date indicator driving wheel 210 and rotation of the month indicator 240 and is constituted to be able to rotate the date indicator 220 at an end of a small month. The small month end feed lever 282 is arranged on an upper side of the date indicator driving wheel 210 and is constituted to be able to move relative to the center of rotation of the date indicator driving wheel 210. The center of rotation of the date indicator driving wheel 210 is constituted by a date indicator driving wheel pin 102P provided at the main plate 102.

The date indicator driving wheel 210 includes the lever drive pin 211. The lever drive pin 211 is arranged at the notched portion 282B of the small month end feed lever 282. The small month end feed lever 282 is rotated by the lever drive pin 211. The lever long hole 282C of the small month end feed lever 282 is arranged to the date indicator driving wheel pin 102P. The small month end feed lever 282 is constituted to be able to move to the small month end feed tooth 288 in a direction directed to an outer side in the radius direction from the center of the main plate 102 based on rotation of the date indicator driving wheel 210 along the month cam 248 provided at the month indicator 240 by guiding the lever long hole 282C by the date indicator driving wheel pin 102P. By constituting in this way, the calendar mechanism-attached timepiece stabilizing operation of the date feed mechanism and the month feed mechanism can be realized. Further, by the constitution, an extraneous load can be constituted not to apply to a transmission train wheel in normal date feeding.

The intermediate month wheel 272 is arranged to be able to rotate the month indicator 240 by being rotated based on rotation of the date indicator 220. The intermediate month wheel 272 is constituted to be able to feed the month indicator 240 at an end of a month. The intermediate month wheel 272 is provided to be able to rotate relative to the main plate 102. The intermediate month wheel 272 includes an intermediate month tooth portion 272B.

When the date indicator 220 is rotated such that indication of the date indicator 220 becomes '1-th date' from '31-th date', the month feed tooth 274 of the date indicator 220 is constituted to be able to rotate the intermediate month wheel 272 by being brought into contact with the intermediate month tooth portion 272B of the intermediate month wheel 272. By rotation of the intermediate month wheel 272, the intermediate month tooth portion 272B is constituted to be able to change the indication of the month indicator 240 by rotating the month indicator 240 by rotating the month wheel 242.

It is preferable to arrange the date indicator driving wheel 210 arranged on the back side of the movement 100 so as not to overlap the battery 440 arranged on the top side of the movement 100 in view of a section thereof. Further, it is preferable to arrange the month feed setting lever 250 arranged on the back side of the movement 100 so as not to overlap the battery 440 arranged on the top side of the movement 100 in view of a section thereof. By constituting in this way, the calendar mechanism-attached timepiece having a thin thickness of the movement can be realized.

(5) Constitution of Calendar Correcting Mechanism:

In reference to FIG. 1 and FIG. 4, in the movement 100, a calendar correcting mechanism includes the first calendar corrector setting wheel 291, a second calendar corrector setting wheel 292, a date corrector setting wheel 293, a month corrector setting wheel 294, and a corrector setting wheel spring 595. The corrector setting wheel spring 595 can be formed integrally with the date indicator maintaining plate 264. The corrector setting wheel spring 595 is constituted to press the date corrector setting wheel 293 to the main plate 102. The date corrector setting wheel 293 is constituted to be able to pivot along a guide hole provided at the main plate 102. It is preferable to arrange a center of rotation of the date corrector setting wheel 293 between '1 o'clock direction' and '2 o'clock direction' in the movement 100. It is preferable to arrange a center of rotation of the month corrector setting wheel 294 between '12 o'clock direction' and '1 o'clock direction' in the movement 100.

In a state in which the hand setting stem 110 is disposed at 1 stage, it is constituted that a cooperatively moving hole of the first calendar corrector setting wheel 291 is fitted to the second angle portion 116 of the hand setting stem 110, and the first calendar corrector setting wheel 291 is rotated based on rotation of the hand setting stem 110. Under the state, when the hand setting stem 110 is rotated in a first direction, based on rotation of the first calendar corrector setting wheel 291, the second calendar corrector setting wheel 292 is constituted to be rotated.

Based on rotation of the second calendar corrector setting wheel 292, the date corrector setting wheel 293 is pivoted to stop at a position of being brought in mesh with the date indicator tooth portion 226 of the date indicator 220 and the date corrector setting wheel 293 is constituted to rotate at the correcting position. When the date corrector setting wheel 293 is rotated at the correcting position, the date indicator 220 is constituted to be able to rotate in the counterclockwise direction. In a state in which the hand setting stem 110 is disposed at 1 stage, when the hand setting stem 110 is rotated in a second direction constituting a direction opposed to the first direction, based on rotation of the first calendar corrector setting wheel 291, the second calendar corrector setting wheel 292 is constituted to rotate.

Based on rotation of the second calendar corrector setting wheel 292, the date corrector setting wheel 293 is moved in a direction of being remote from the date indicator tooth portion 226 of the date indicator 220 and pivoted to stop to a position of being brought in mesh with the month corrector setting wheel 294 and the date corrector setting wheel 293 is constituted to rotate at the correcting position. The tooth portion of the month corrector setting wheel 294 is constituted to be brought in mesh with the month star wheel tooth portion 246. When the date corrector setting wheel 293 is rotated to the correcting position, the month indicator 240 is constituted to be able to rotate in the clockwise direction by way of rotation of the month corrector setting wheel 294.

Figure 19:
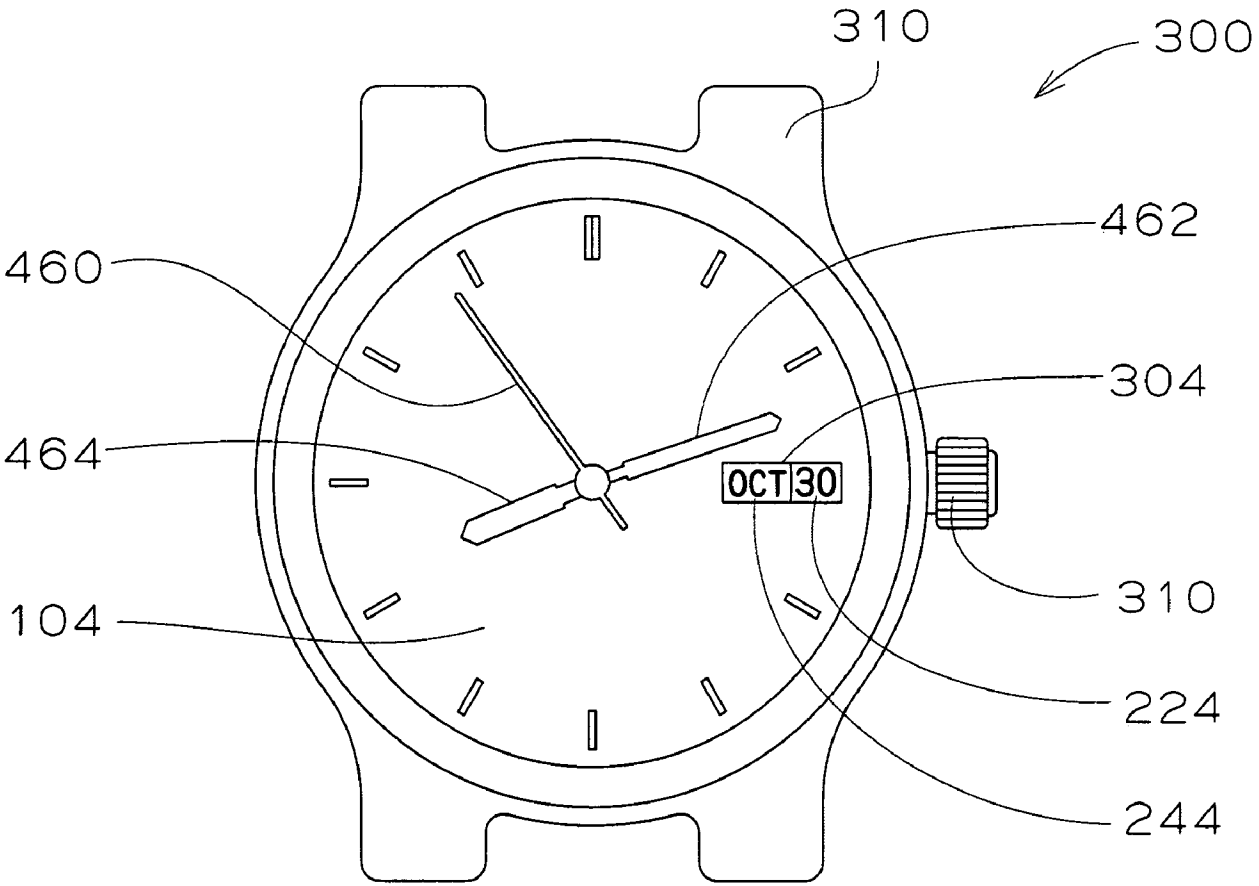
FIG. 19 is a plane view showing a complete in a state of indicating October 30 by a constitution of arranging a date window in 3 o'clock direction of a dial according to the embodiment of the calendar mechanism-attached timepiece of the invention.
Figure 20:
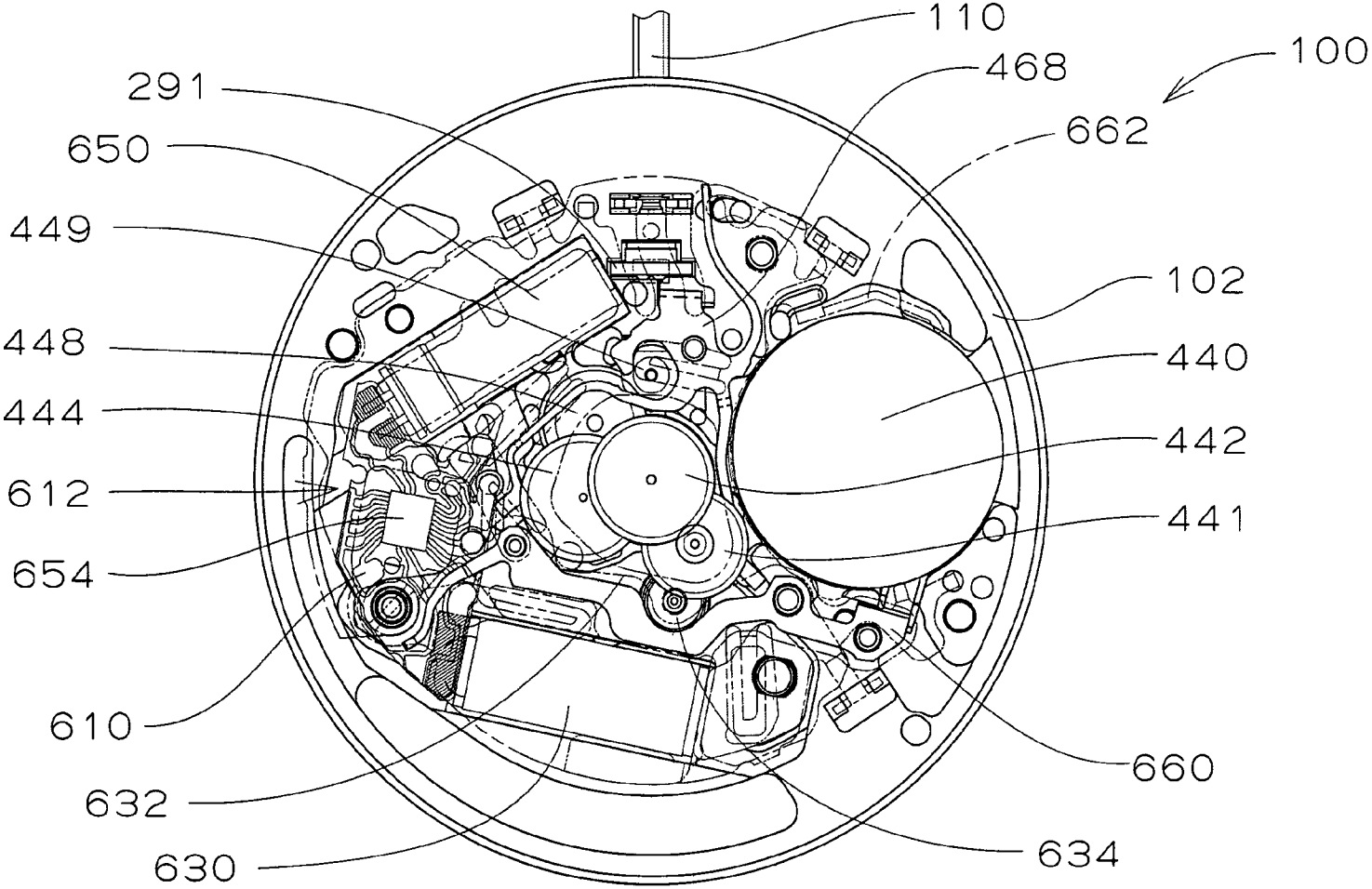
FIG. 20 is an outline plane view showing a structure when a movement is viewed from a case back side according to the embodiment of the calendar mechanism-attached timepiece of the invention.

(6) Operation of Calendar Mechanism-Attached Timepiece:

(6•1) Indication of Time Information:

Next, an operation of the calendar mechanism-attached timepiece of the invention will be explained. In reference to FIG. 19, a complete 300 is constituted by integrating the movement 100 into a timepiece case 310 and attaching the dial 104, a crown 310, an hour hand 464, a minute hand 462, and a second hand 460. A character '30' indicating a date provided at the date indicating face portion 224, and a character 'OCT' indicating a month provided at the month indicating face portion 244 can be read from a window 304 provided at the dial 104. That is, the complete 300 indicates 'October 30'. Although FIG. 19 shows an embodiment of a calendar mechanism-attached timepiece formed with the window 304 in '3 o'clock direction' of the dial 104, the calendar mechanism-attached timepiece formed with a window at a position other than '3 o'clock direction' of the dial 104 can be realized by pertinently selecting arrangements and directions of the date character and the month character.

In reference to FIG. 1 through FIG. 4, FIG. 19 and FIG. 20, when the step motor is driven by the battery 440, the quartz unit 650, the integrated circuit (IC) 654, the rotor 634 is rotated by a constant speed. Based on rotation of the rotor 634, the fourth wheel & pinion 442 is rotated by way of rotation of the fifth wheel & pinion 441. By the secondhand 460 attached to the fourth wheel & pinion 442, 'second' in time information is indicated. The third wheel & pinion 444 is rotated based on rotation of the fourth wheel & pinion 442. The center wheel & pinion 446 is rotated based on rotation of the third wheel & pinion 444. By the minute hand 462 attached to the center wheel & pinion 446, 'minute' in time information is indicated. The minute wheel 448 is rotated based on rotation of the center wheel & pinion 446. The hour wheel & pinion 180 is rotated based on rotation of the minute wheel 448. By the hour hand 464 attached to the hour wheel & pinion 180, 'hour' in time information is indicated.

(6•2) Operation of Calendar Feeding (6•2•1) Operation Other than Month End in 'Large Month':

Next, an operation of calendar feeding of the calendar mechanism-attached timepiece of the invention will be explained. In reference to FIG. 1 through FIG. 4 and FIG. 21, at other than a month end of 'large month', the lever long hole 282C of the small month end feed lever 282 is guided by the date indicator driving wheel pin 102P, the small month end feed cam 284 of the small month end feed lever 282 is arranged at a position of being able to be brought into contact with the month cam 248 of the month indicator 240, the small month end feed lever 282 can be arranged at a position on an outer side in the radius direction of the main plate 102 (position shown in FIG. 1). The small month end feed lever 282 can freely be moved between the position on the outer side in the radius direction of the main plate 102 and the position on the outer side in the radius direction of the main plate 102. The month feed tooth 274 of the date indicator 220 is arranged at a position of not being brought into contact with an intermediate month tooth portion 272B of the intermediate month wheel 272.

Under the state, when the date indicator driving wheel 210 is rotated by rotation of the hour wheel & pinion 180, also the date feed finger 212 and the lever drive pin 211 are simultaneously rotated. When the date feed finger 212 is rotated, the date feed portion 213 of the date feed finger 212 can feed the date indicator tooth portion 226 of the date indicator 220 by one tooth in the counterclockwise direction. The operation of date feeding can be constituted to carry out between 8 o'clock in the afternoon and 12 o'clock in the afternoon. Under the state, even when the date indicator 220 is rotated, the intermediate month wheel 272 is not rotated. A position in a direction of rotating the date indicator 220 after the operation of date feeding is set by the date jumper 260.

Further, under the state, when the date indicator driving wheel 210 and the lever drive pin 211 are rotated, although the small month end feed lever 282 is rotated by constituting a center of rotation by the date indicator driving wheel pin 102P, the small month end feed finger 286 of the small month end feed lever 282 is arranged at a position of not being brought into contact with the small month end feed tooth 288 of the date indicator 220. Therefore, under the state, even when the small month end feed lever 282 is rotated, the date indicator 220 is not rotated. Therefore, at other than the month end of 'large month', the date indicator tooth portion 226 of the date indicator 220 is fed by one tooth and indication of the date is changed by an amount of 1 day. Further, at other than the month end of 'large month', month feeding is not carried out, and therefore, the indication of month is not changed.

(6•2•2) Operation at Other than Month End in 'Small Month':

In reference to FIG. 2 through FIG. 4 and FIG. 21, at other than the month end of 'small month', the lever long hole 282C of the small month end feed lever 282 is guided by the date indicator driving wheel pin 102P, and the small month end feed cam 284 of the small month end feed lever 282 is arranged at a position in correspondence with the small month detecting cam 249 of the month indicator 240.

Under the state, when the date indicator driving wheel 210 and the lever drive pin 211 are rotated, although the small month end feed lever 282 is rotated by constituting the center of rotation by the date indicator driving wheel pin 102P, the small month end feed finger of the small month end feed lever 282 is arranged at a position of not being brought into contact with the small month end feed tooth 288 of the date indicator 220. Under the state, even when the small month end feed lever 282 is rotated, the date indicator 220 is not rotated. Therefore, at other than the month end of 'small month', the date indicator tooth portion 226 of the date indicator 220 is fed by one tooth and the indication of the date is changed by an amount of 1 day. A position in a direction of rotating the date indicator 220 after the operation of date feeding is set by the date jumper 260. Further, at other than the month end of 'small month', month feeding is not carried out, and therefore, the indication of the month is not changed. That is, the operation at other than the month end of 'small month' is similar to the operation at other than the month end of 'large month' mentioned above.

(6•2•3) Operation of Changing from ''30-th Date' to '31-th Date' in 'Large Month':

In reference to FIG. 5 through FIG. 9 and FIG. 21, in a state of indicating '30-th date' of 'large month', the indication of month is 'OCT' in correspondence with 'October'. The small month end feed lever 282 can be arranged at a position on an outer side in the radius direction of the main plate 102 (position shown in FIG. 5). The small month end feed lever 282 can freely be moved between a position on an inner side in the radius direction of the main plate 102 and a position on the outer side in the radius direction of the main plate 102. The month feed tooth 274 of the date indicator 220 is arranged at a position of not being brought into contact with the intermediate month tooth portion 272B of the intermediate month wheel 272.

Figure 6:
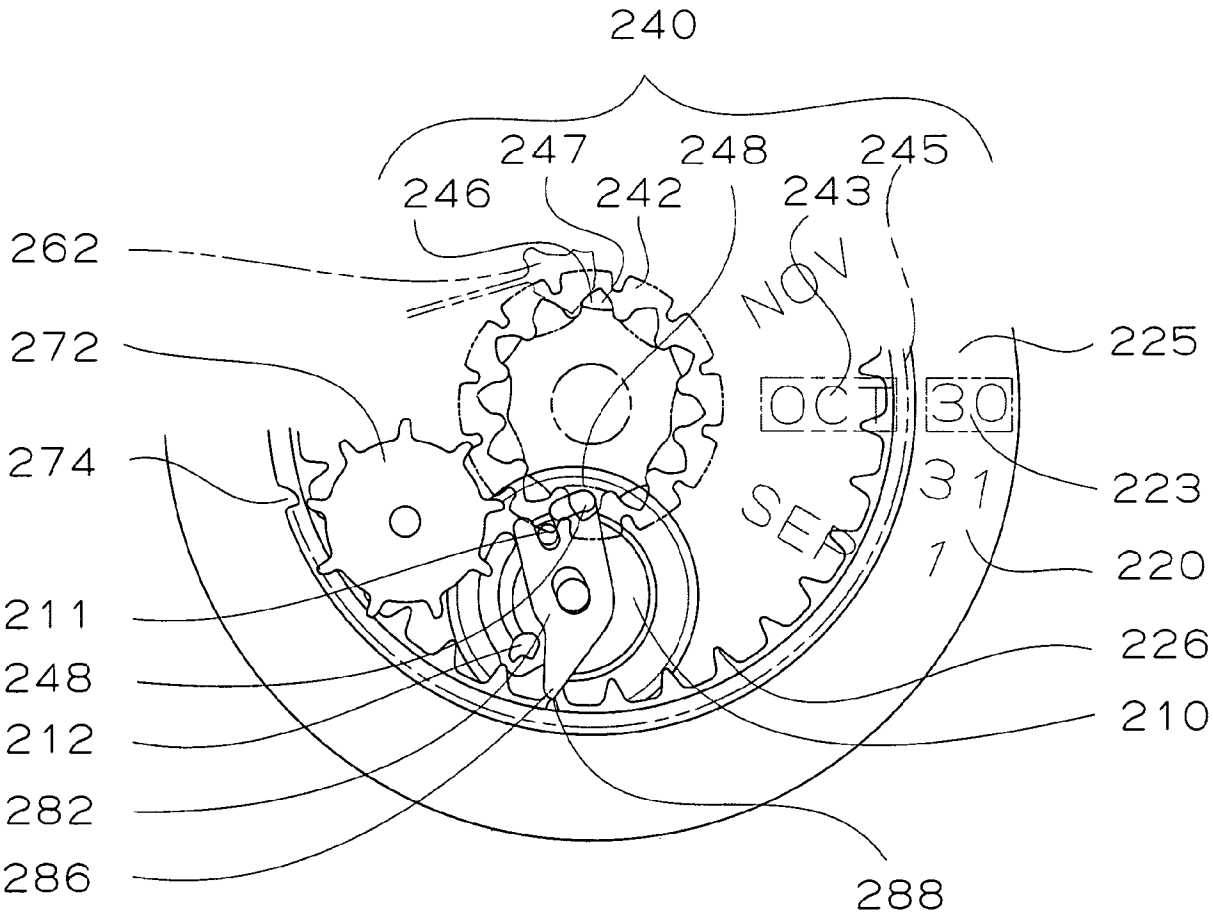
FIG. 6 is a partial plane view (part 2) showing the structures of the date feeding mechanism and the month feeding mechanism in a state of changing from October 30 to October 31 according to the embodiment of the calendar mechanism-attached timepiece of the invention.

In reference to FIG. 6, when the date indicator driving wheel 210 is rotated by rotation of the hour wheel & pinion 180, also the date feed finger 212 and the lever drive pin 211 are simultaneously rotated. When the date feed finger 212 is rotated, the date feed portion 213 of the date feed finger 212 can be rotated in the counterclockwise direction to be proximate to the date indicator tooth portion 226 of the date indicator 220. Under the state, even when the date indicator 220 is rotated, the intermediate month wheel 272 is not rotated.

Further, in the state, when the date indicator driving wheel 210 and the lever drive pin 211 are rotated, the small month end feed lever 282 is rotated by constituting the center of rotation by the date indicator driving wheel pin 102P, and the small month end feed finger 286 of the small month end feed lever 282 is brought into contact with the small month end feed tooth 288 of the date indicator 220. By the small month end feed tooth 288 of the date indicator 220, the small month end feed lever 282 is moved to the position on the inner side in the radius direction of the main plate 102. Therefore, in the state, even when the small month end feed lever 282 is rotated, the date indicator 220 is not rotated.

Figure 7:
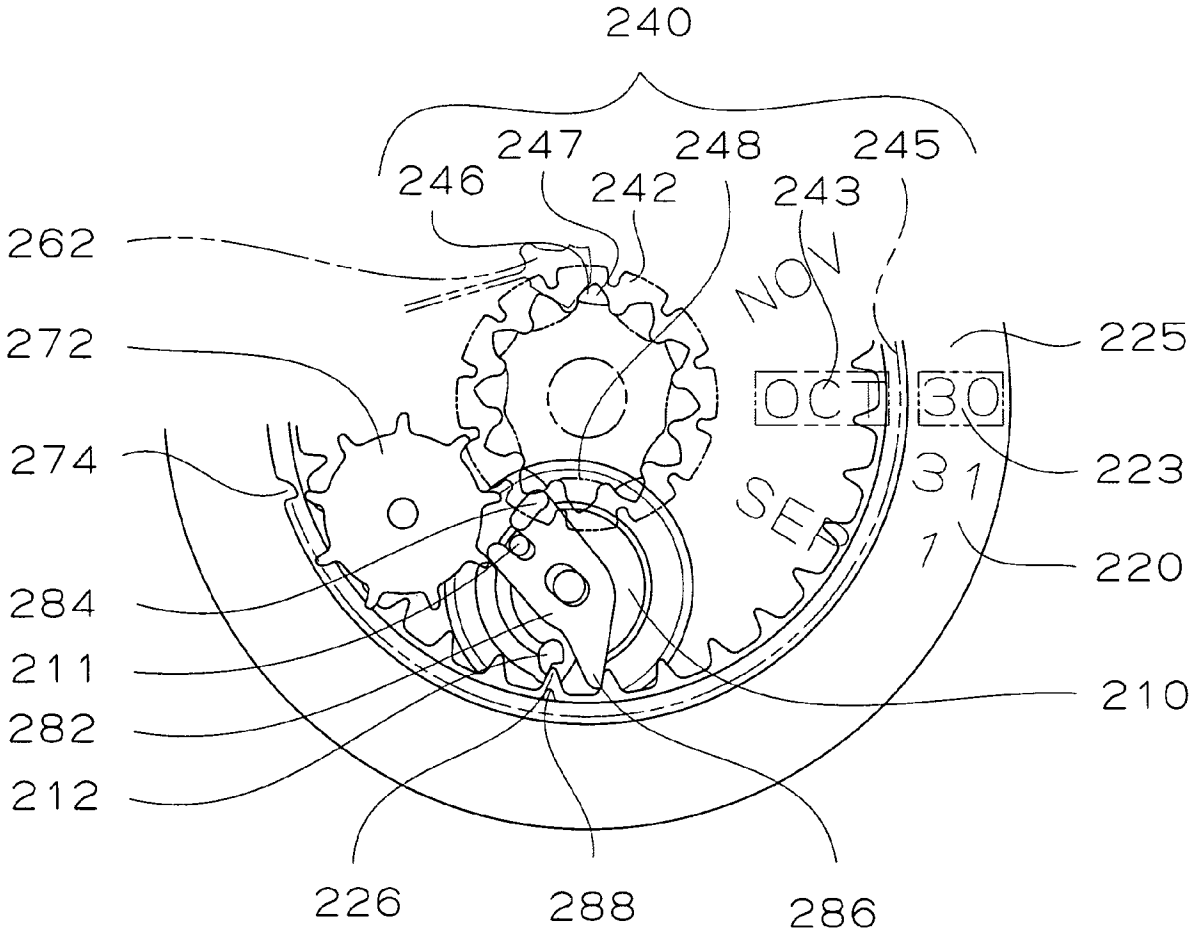
FIG. 7 is a partial plane view (part 3) showing structures of the date feeding mechanism and the month feeding mechanism in a state of changing from October 30 to October 31 according to the embodiment of the calendar mechanism-attached timepiece of the invention.

In reference to FIG. 7, when the date indicator driving wheel 210 is rotated further, the date feed finger 212 is rotated further, and the date feed portion 213 of the date feed finger 212 is brought into contact with one tooth of the date indicator tooth portion 226 of the date indicator 220. On the other hand, the month feed tooth 274 of the date indicator 220 is arranged at a position of not being brought into contact with the intermediate month tooth portion 272B of the intermediate month wheel 272.

Figure 8:
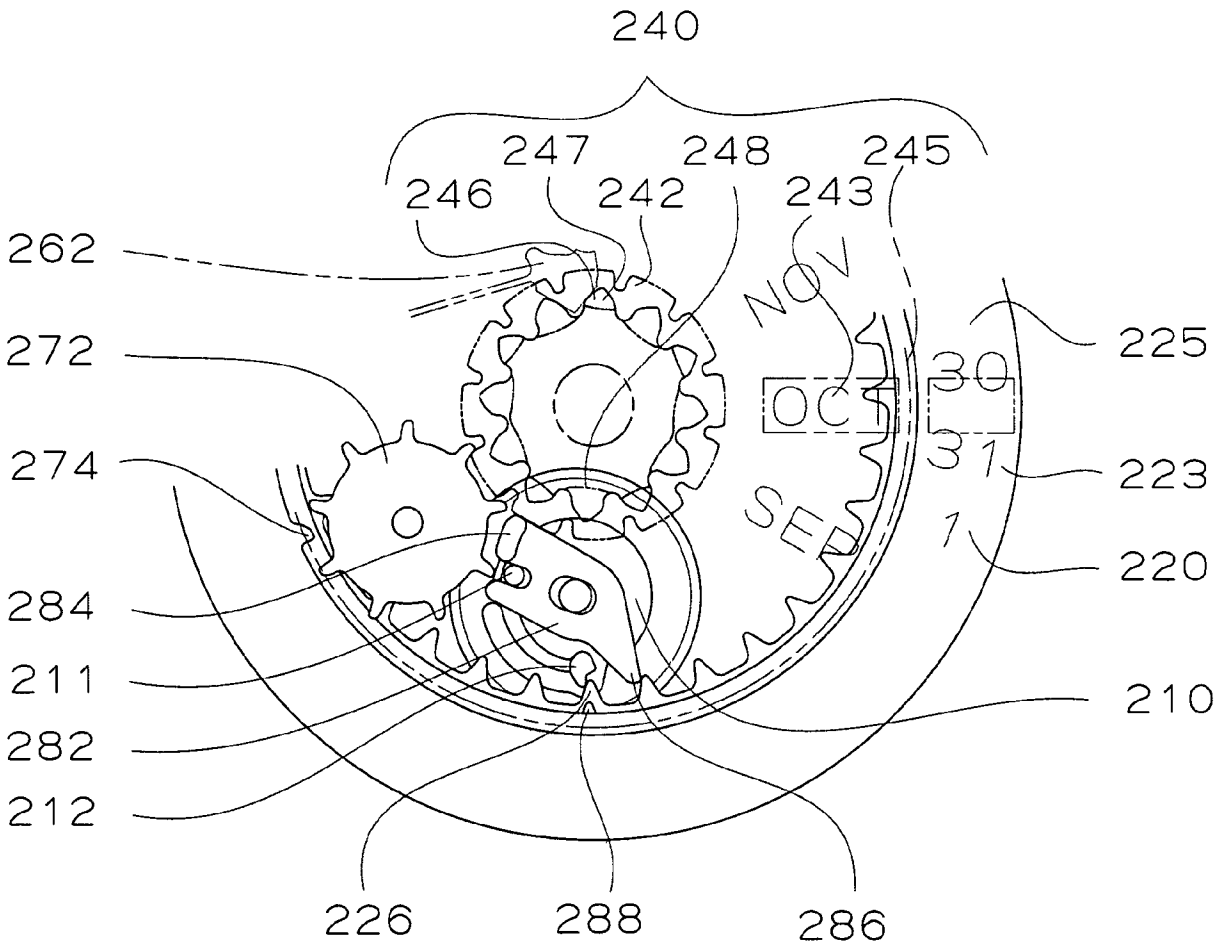
FIG. 8 is a partial plane view (part 4) showing the structures of the date feeding mechanism and the month feeding mechanism in a state of changing from October 30 to October 31 according to the embodiment of the calendar mechanism-attached timepiece of the invention.

In reference to FIG. 8, when the date indicator driving wheel 210 is rotated further, the date feed finger 212 is rotated further, and the date indicator tooth portion 226 of the date indicator 220 can be fed in the counterclockwise direction by one tooth. The position in the direction of rotating the date indicator 220 after operation of date feeding is set by the date jumper 260. On the other hand, the month feed tooth 274 of the date indicator 220 is arranged at a position of not being brought into contact with the intermediate month tooth portion 272B of the intermediate month wheel 272.

Figure 9:
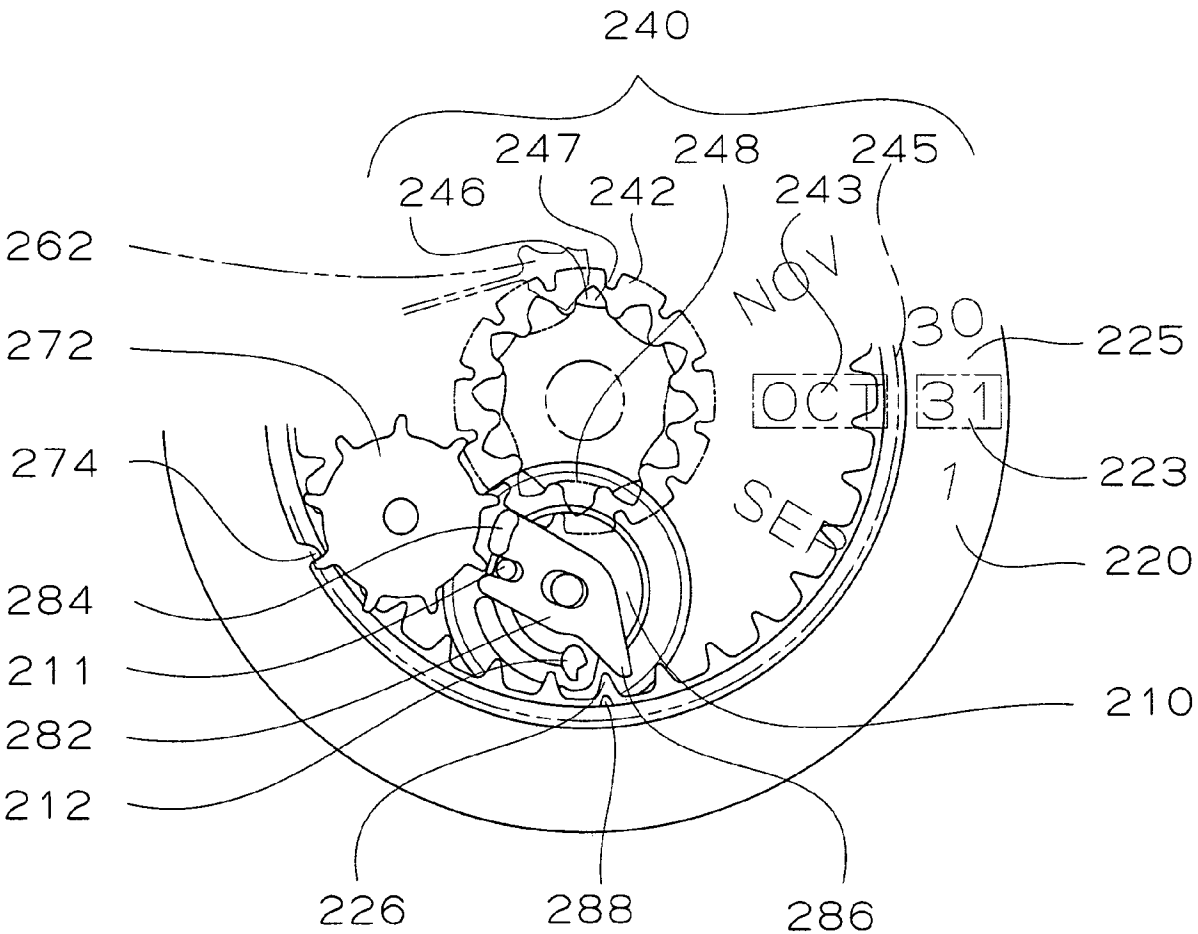
FIG. 9 is a partial plane view (part 5) showing the structures of the date feeding mechanism and the month feeding mechanism in a state of changing from October 30 to October 31 according to the embodiment of the calendar mechanism-attached timepiece of the invention.
Figure 10:
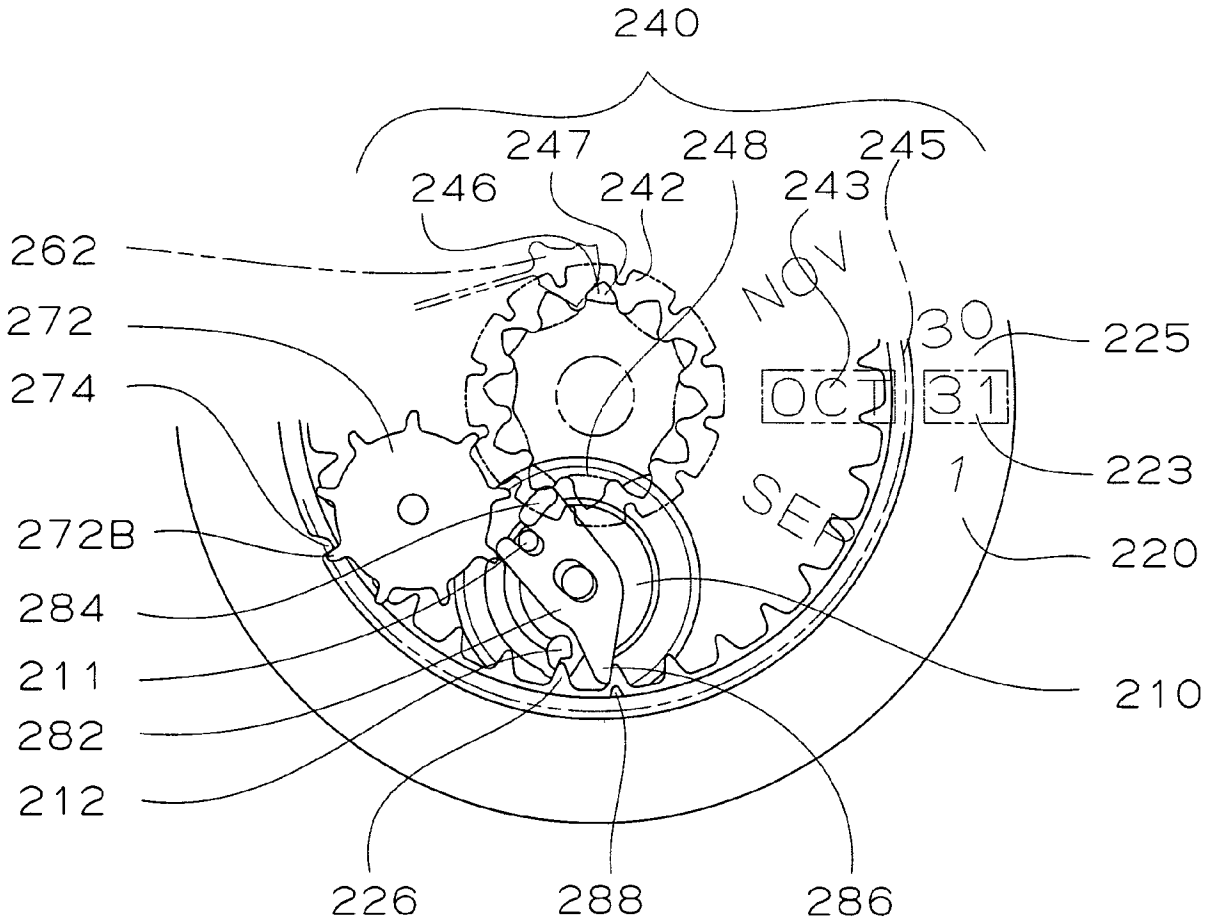
FIG. 10 is a partial plane view (part 1) showing the structures of the date feeding mechanism and the month feeding mechanism in a state of changing from October 31 to November 1 according to the embodiment of the calendar mechanism-attached timepiece of the invention.

In reference to FIG. 9, the date feed finger 212 finishes feeding the date indicator tooth portion 226 of the date indicator 220 by one tooth in the counterclockwise direction, and the indication of date is changed to '31-th date'. The month feed tooth 274 of the date indicator 220 is arranged at a position of not being brought into contact with the intermediate month tooth portion 272B of the intermediate month wheel 272. Therefore, when the state is changed from a state of indicating '30-th date' of 'large month' to a state of indicating '31-th date', month feeding is not carried out, and therefore, indication of month is not changed but stays to be 'OCT'. The operation of changing from '30-th date' to '31-th date' in 'large month' other than 'October' is similar to operation of changing from '30-th date' to '31-th date' of 'October'.

(6•2•4) Operation of Changing from '31-th Date' to '1-th Date' of Next Month in 'Large Month':

In reference to FIG. 2 through FIG. 4, FIG. 10 and FIG. 21, in a state of indicating '31-th date' of 'large month', the indication of month is 'OCT' in correspondence with 'October'. Under the state, the small month end feed lever 282 can be arranged at a position on the outer side in the radius direction of the main plate 102 (position shown in FIG. 10). The small month end feed lever 282 can freely be moved between the position on the outer side in the radius direction of the main plate 102 and the position on the outer side in the radius direction of the main plate 102. The month feed tooth 274 of the date indicator 220 is arranged at a position of capable of being brought into contact with the intermediate month tooth portion 272B of the intermediate month wheel 272.

Figure 11:
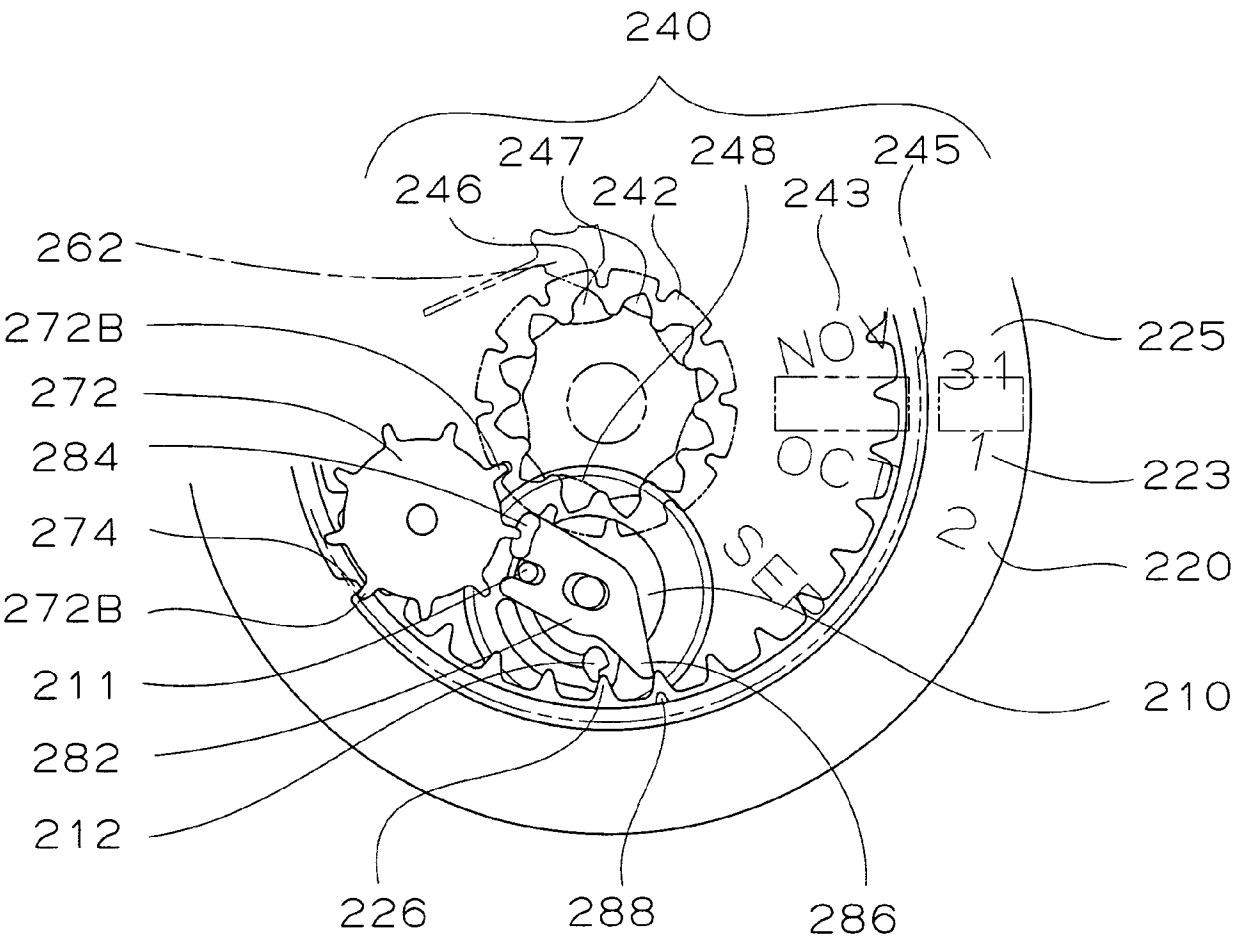
FIG. 11 is a partial plane view (part 2) showing the structures of the date feeding mechanism and the month feeding mechanism in a state of changing from October 31 to November 1 according to the embodiment of the calendar mechanism-attached timepiece of the invention.
Figure 21:
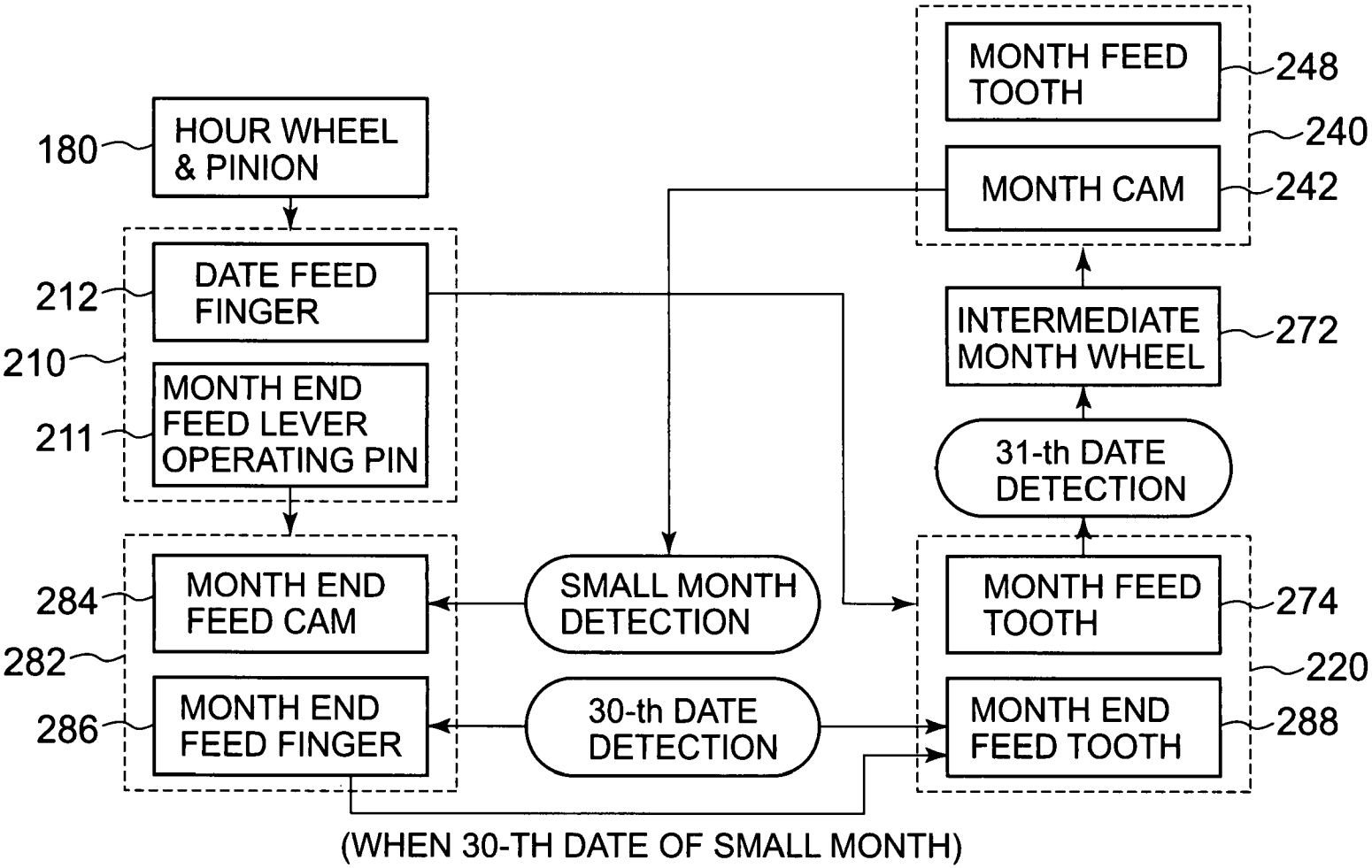
FIG. 21 is an outline block diagram showing a constitution of a calendar mechanism according to the embodiment of the calendar mechanism-attached timepiece of the invention.

In reference to FIG. 11 and FIG. 21, when the date indicator driving wheel 210 is rotated by rotation of the hour wheel & pinion 180, also the date feed finger 212 and the lever drive pin 211 are simultaneously rotated. When the date feed finger 212 is rotated, the date feed portion 213 of the date feed finger 212 can be rotated in the counterclockwise direction to be proximate to the date indicator tooth portion 226 of the date indicator 220. Under the state, when the date indicator 220 is rotated in the counterclockwise direction, the month feed tooth 274 of the date indicator 220 is brought into contact with the intermediate month tooth portion 272B of the intermediate month wheel 272. That is, when the month feed tooth 274 of the date indicator 220 is arranged at a position of '31-th date detection', the intermediate month wheel 272 can be rotated in the counterclockwise direction. When the intermediate month wheel 272 is rotated in the counterclockwise direction, the month wheel 242 is rotated in the clockwise direction.

Further, under the state, when the date indicator driving wheel 210 and the lever drive pin 211 are rotated, although the small month end feed lever 282 is rotated by constituting a center of rotation by the date indicator driving wheel pin 102P, the small month end feed finger 286 of the small month end feed lever 282 is not brought into contact with the small month end feed finger 286 of the date indicator 220. Therefore, under the state, even when the small month end feed lever 282 is rotated, the date indicator 220 is not rotated.

Figure 12:
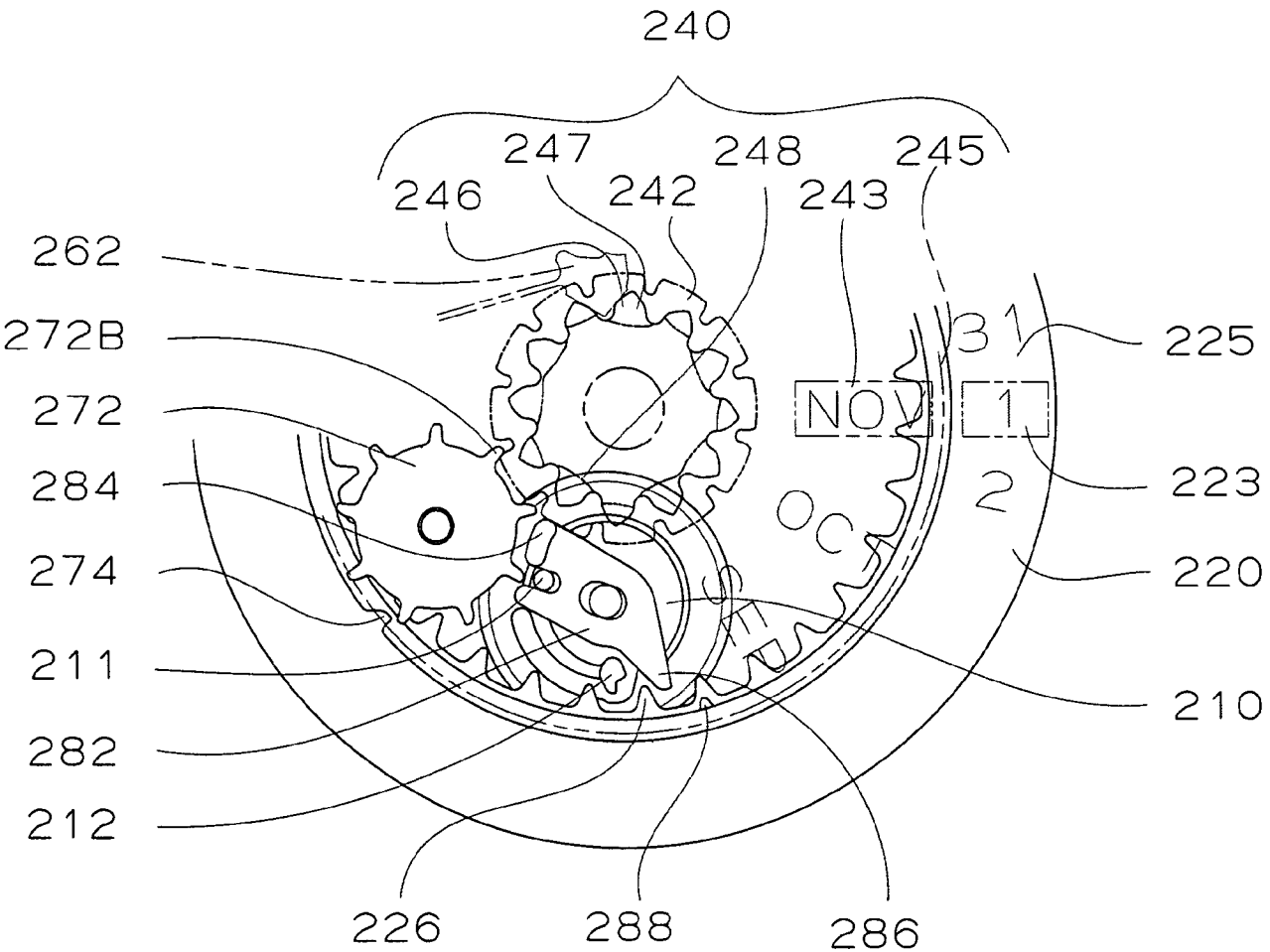
FIG. 12 is a partial plane view (part 3) showing the structures of the date feeding mechanism and the month feeding mechanism in a state of changing from October 31 to November 1 according to the embodiment of the calendar mechanism-attached timepiece of the invention.

In reference to FIG. 12, when the date indicator driving wheel 210 is rotated further, the date feed finger 212 is rotated further, and the date indicator tooth portion 226 of the date indicator 220 can be fed in the counterclockwise direction by one tooth. A position in the direction of rotating the date indicator 220 after the operation of date feeding is set by the date jumper 260. On the other hand, the month feed tooth 274 of the date indicator 220 can rotate the intermediate month wheel 272 and the intermediate month wheel 272 can feed the month star wheel tooth portion 246 of the month star wheel 247 in the clockwise direction by one tooth. The position in the direction of rotating the month indicator 230 after the operation of month feeding is set by the month jumper 262.

The date feed finger 212 finishes feeding the date indicator tooth portion 226 of the date indicator 220 by one tooth in the counterclockwise direction, and the indication of date is changed to '1-th date'. The month feed tooth 274 of the date indicator 220 finishes feeding the month star wheel tooth portion 246 of the month star wheel 247 by one tooth in the clockwise direction by way of rotation of the intermediate month wheel 272, and the indication of month is changed to 'NOV'. The operation of date feeding and month feeding can be constituted to carry out between 8 o'clock in the afternoon and 12 o'clock in the afternoon, for example. An operation at a month end of 'large month' other than 'October' is similar to the operation at the month end of 'October'.

(6•2•5) Operation of Changing from '30-th Date' to '1-th Date' of Next Month in 'Small Month':

In reference to FIG. 1 through FIG. 4, FIG. 13 and FIG. 21, in a state of indicating '30-th date' of 'small month', the indication of month is 'NOV' in correspondence with 'November', the indication of date is '30' in correspondence with '30-th date'. Under the state, the November cam 249E of the month indicator 240 is arranged at a position of being brought into contact with the small month end feed cam 284 of the small month end feed lever 282. That is, the November cam 249E of the month indicator 240 is arranged at a position of 'small month detection'. Under the state, the small month end feed lever 282 is arranged at a position on an outer side in the radius direction of the main plate 102 (position shown in FIG. 13). The month feed tooth 274 of the date indicator 220 is arranged at a position of not being brought into contact with the intermediate month tooth portion 272B of the intermediate month wheel 272.

Figure 13:
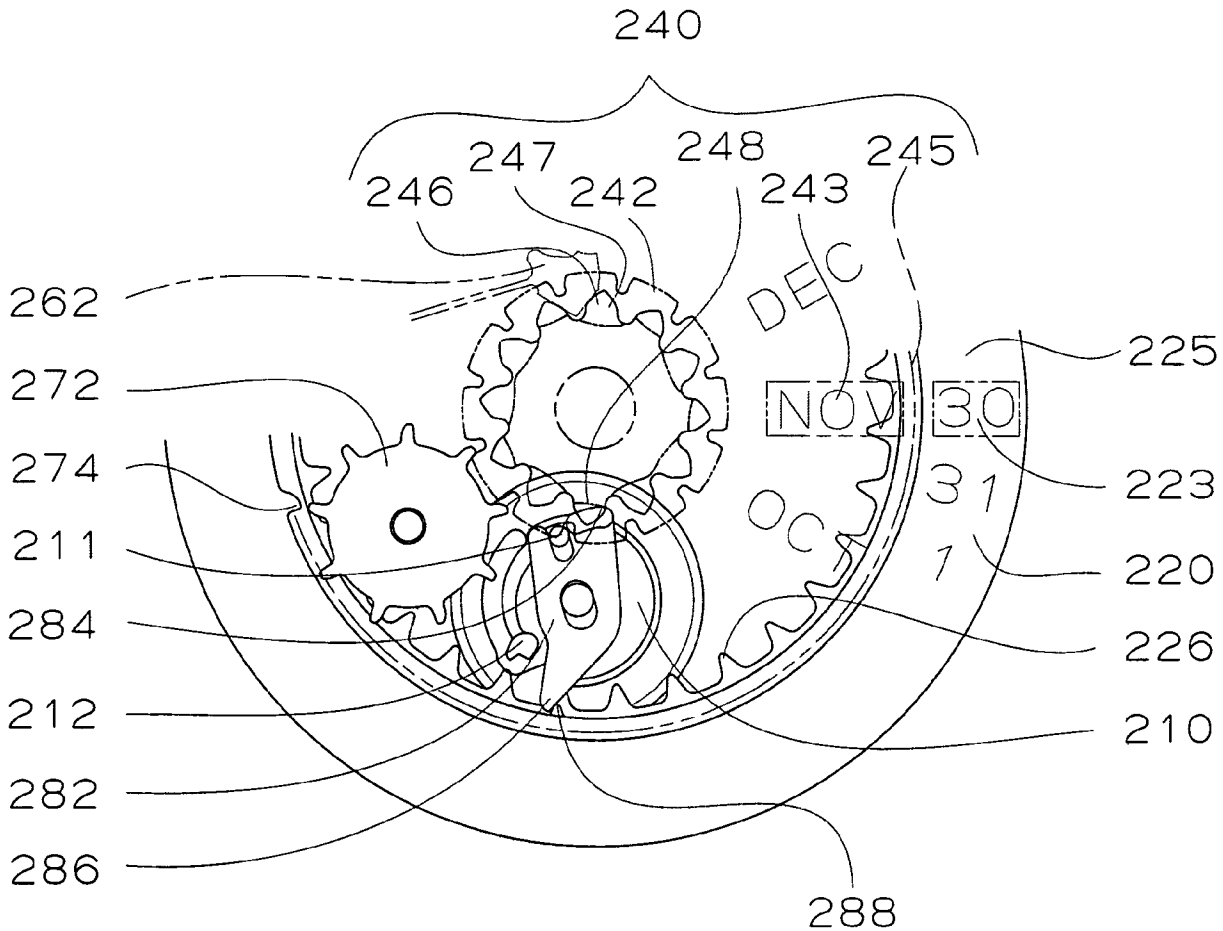
FIG. 13 is a partial plane view (part 1) showing structures of the date feeding mechanism and the month feeding mechanism in a state of changing from November 30 to December 1 according to the embodiment of the calendar mechanism-attached timepiece of the invention.

In reference to FIG. 13, when the date indicator driving wheel 210 is rotated by rotation of the hour wheel & pinion 180, also the date feed finger 212 and the lever drive pin 211 are simultaneously rotated. When the date feed finger 212 is rotated, the date feed portion 213 of the date feed finger 212 can be rotated in the counterclockwise direction to be proximate to the date indicator tooth portion 226 of the date indicator 220. Under the state, even when the date indicator 220 is rotated, the intermediate month wheel 272 is not rotated.

Further, in the state, when the date indicator driving wheel 210 and the lever drive pin 211 are rotated, the small month end feed lever 282 is rotated by constituting the center of rotation by the date indicator driving wheel pin 102P, and the small month end feed finger 286 of the small month end feed lever 282 is brought into contact with the small month end feed tooth 288 of the date indicator 220. That is, in a state of indicating '30-th date' of 'small month', when the small month end feed tooth 288 of the date indicator 220 is arranged at a position of '30-th date detection', by the small month end feed lever 282, the date indicator 220 can be rotated. Further, when the small month end feed lever 282 is rotated, the small month end feed finger 286 can rotate the date indicator 220 by being brought into contact with the small month end feed tooth 288 of the date indicator 220.

Figure 14:
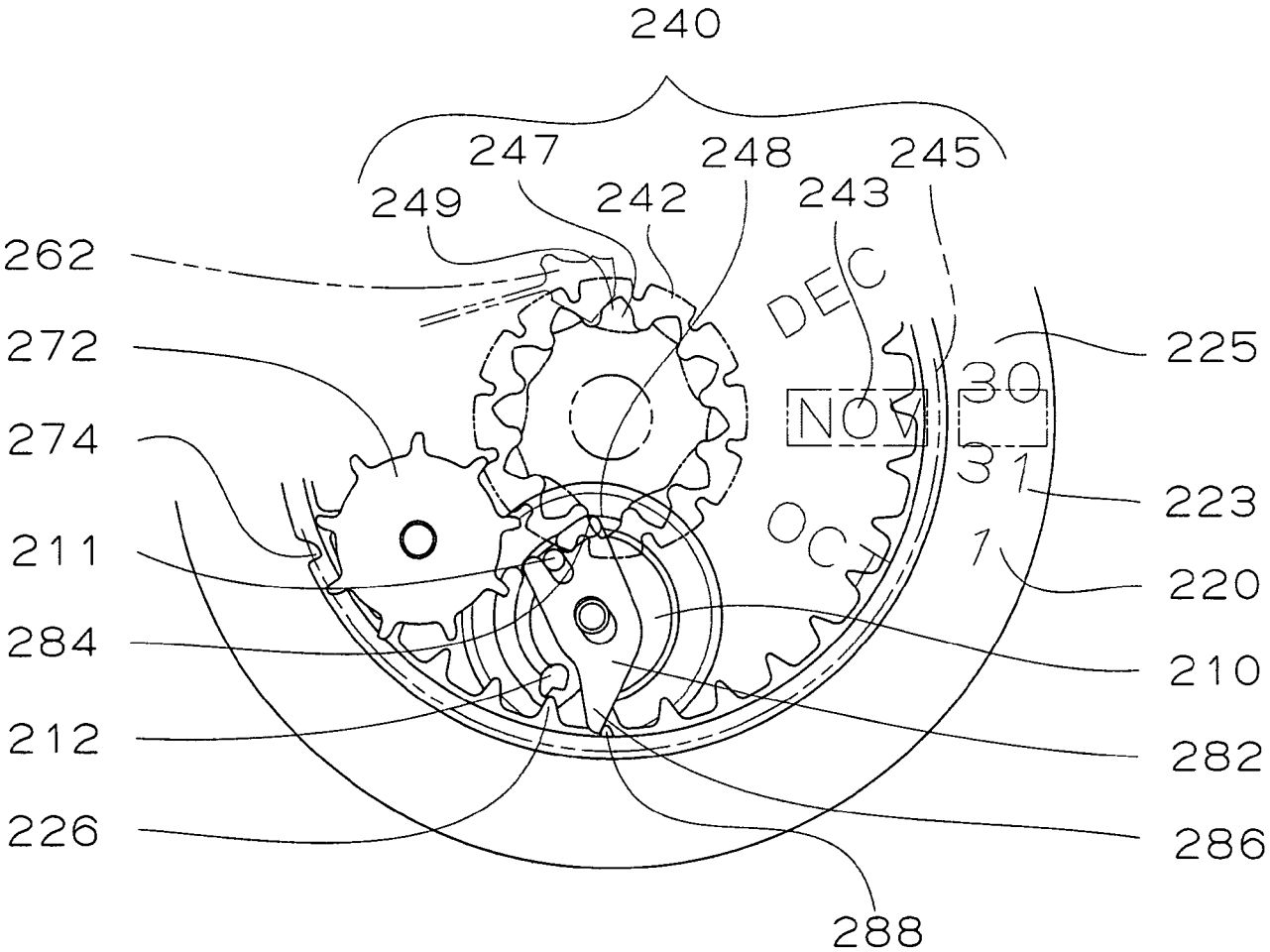
FIG. 14 is a partial plane view (part 2) showing the structures of the date feeding mechanism and the month feeding mechanism in a state of changing from November 30 to December 1 according to the embodiment of the calendar mechanism-attached timepiece of the invention.

In reference to FIG. 14, when the date indicator driving wheel 210 is rotated further, the date feed finger 212 is further rotated, and the date feed portion 213 of the date feed finger 212 becomes proximate to one tooth of the date indicator tooth portion 226 of the date indicator 220. On the other hand, the month feed tooth 274 of the date indicator 220 is arranged at a position of not being brought into contact with the intermediate month tooth portion 272B of the intermediate month wheel 272. Under the state, when the date indicator driving wheel 210 and the lever drive pin 211 are rotated, the small month end feed lever 282 is rotated by constituting the center of rotation by the date indicator driving wheel pin 102P, the small month end feed finger 286 of the small month end feed lever 282 is brought into contact with the small month end feed tooth 288 of the date indicator 220 and rotates the date indicator 220 in the counterclockwise direction.

Figure 15:
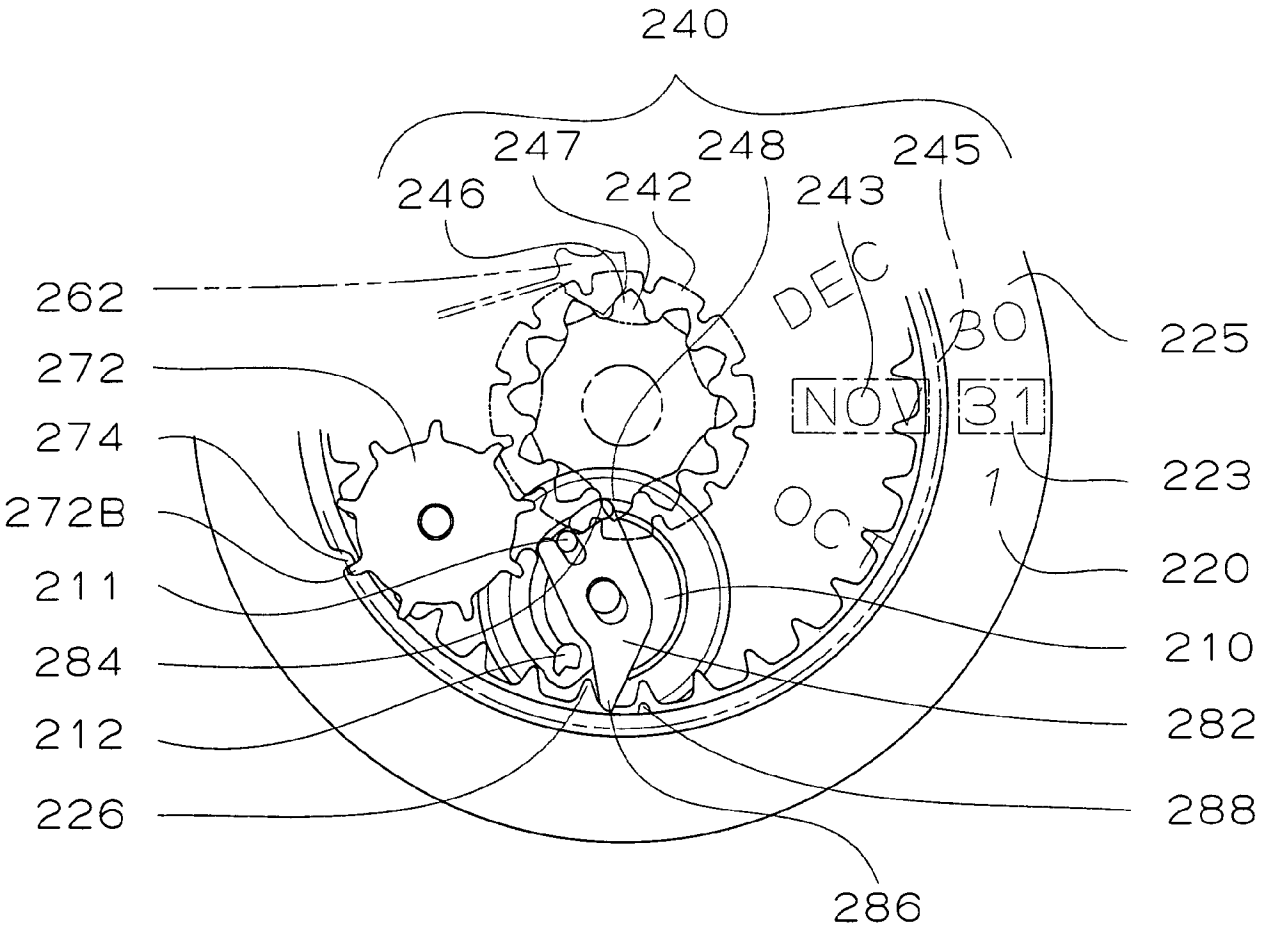
FIG. 15 is a partial plane view (part 3) showing the structures of the date feeding mechanism and the month feeding mechanism in a state of changing from November 30 to December 1 according to the embodiment of the calendar mechanism-attached timepiece of the invention.

In reference to FIG. 15, when the date indicator driving wheel 210 is rotated further, the small month end feed lever 282 is rotated further, and the date indicator tooth portion 226 of the date indicator 220 can be fed in the counterclockwise direction by one tooth. A position in the direction of rotating the date indicator 220 after the operation of date feeding is set by the date jumper 260. As a result, the indication of date is moved from '30' in correspondence with '30-th date' to '31' in correspondence with '31-th date'. On the other hand, the month feed tooth 274 of the date indicator 220 is arranged at a position of being proximate to the intermediate month tooth portion 272B of the intermediate month wheel 272.

Figure 16:
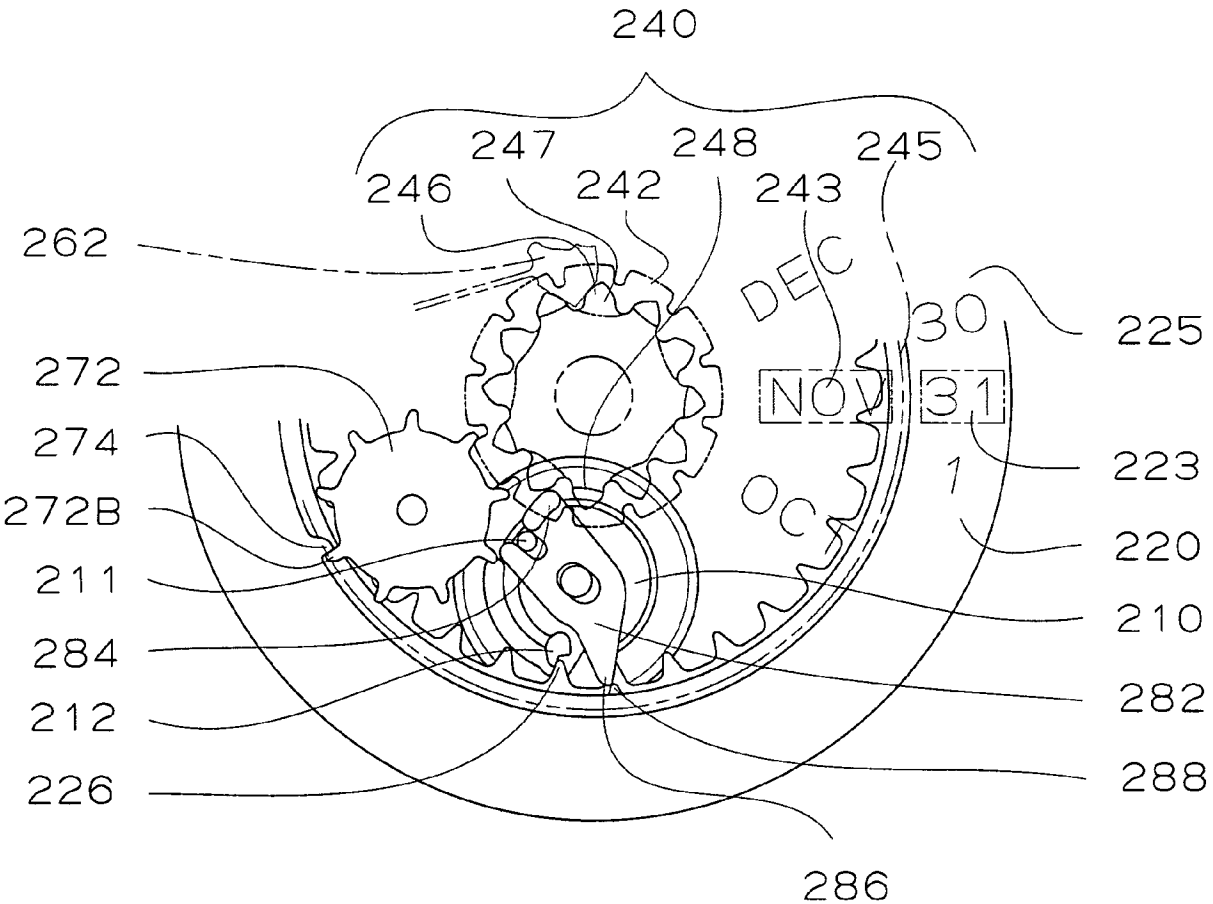
FIG. 16 is a partial plane view (part 4) showing the structures of the date feeding mechanism and the month feeding mechanism in a state of changing from November 30 to December 1 according to the embodiment of the calendar mechanism-attached timepiece of the invention.

In reference to FIG. 16, when the date indicator driving wheel 210 is rotated further, the date feed finger 212 is arranged at a position of being brought into contact with the date indicator tooth portion 226 of the date indicator 220. Further, the month feed tooth 274 of the date indicator 220 is arranged at a position of being brought into contact with the intermediate month tooth portion 272B of the intermediate month wheel 272. Further, the small month end feed finger 286 of the small month end feed lever 282 is arranged at a position of being remote from the small month end feed tooth 288 of the date indicator 220.

Figure 17:
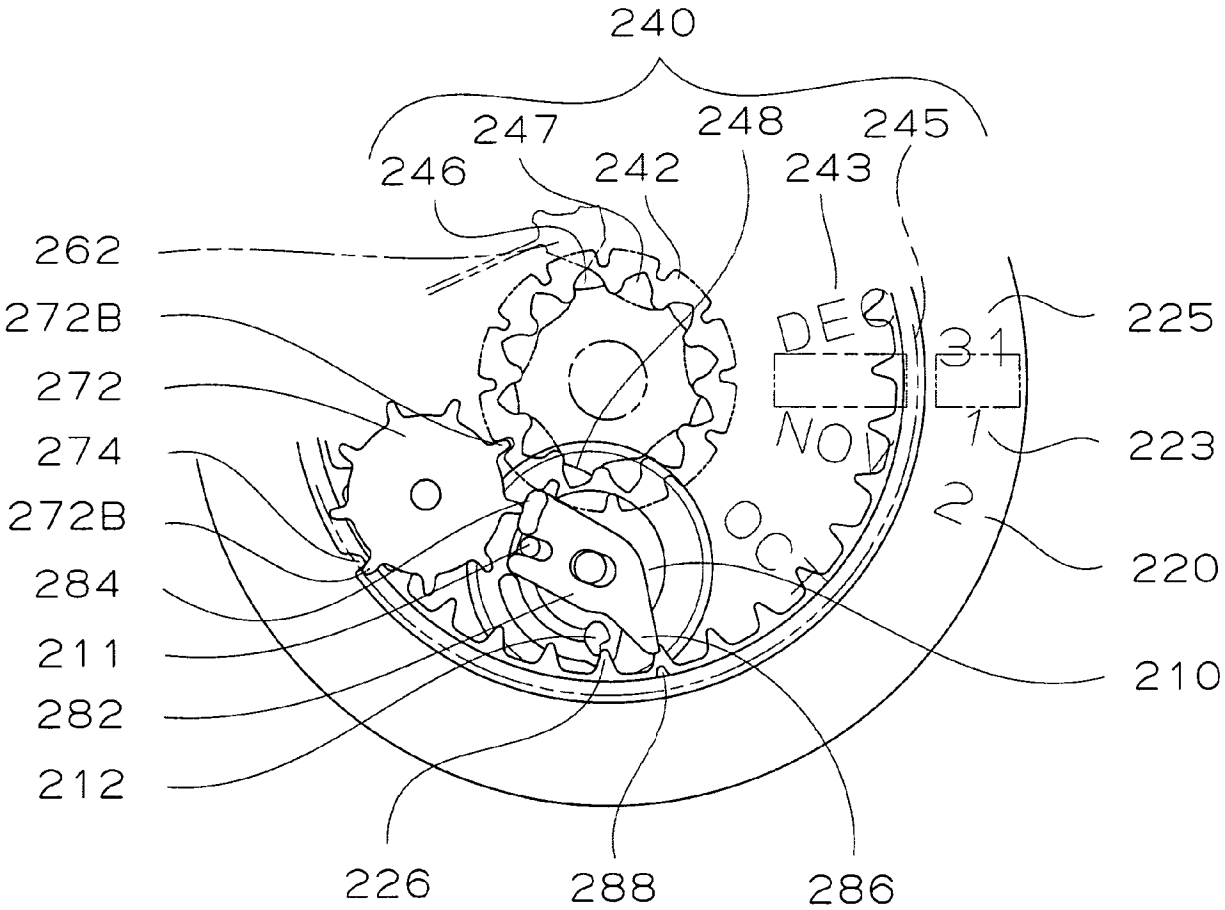
FIG. 17 is a partial plane view (part 5) showing the structures of the date feeding mechanism and the month feeding mechanism in a state of changing from November 30 to December 1 according to the embodiment of the calendar mechanism-attached timepiece of the invention.

In reference to FIG. 17 and FIG. 21, when the date indicator driving wheel 210 is rotated further, the date feed finger 212 is rotated further, and the date indicator tooth portion 226 of the date indicator 220 can be rotated in the counterclockwise direction. On the other hand, the month feed tooth 274 of the date indicator 220 can rotate the intermediate month wheel 272 in the counterclockwise direction, and the intermediate month wheel 272 can rotate the month star wheel tooth portion 246 of the month star wheel 247 in the clockwise direction.

Figure 18:
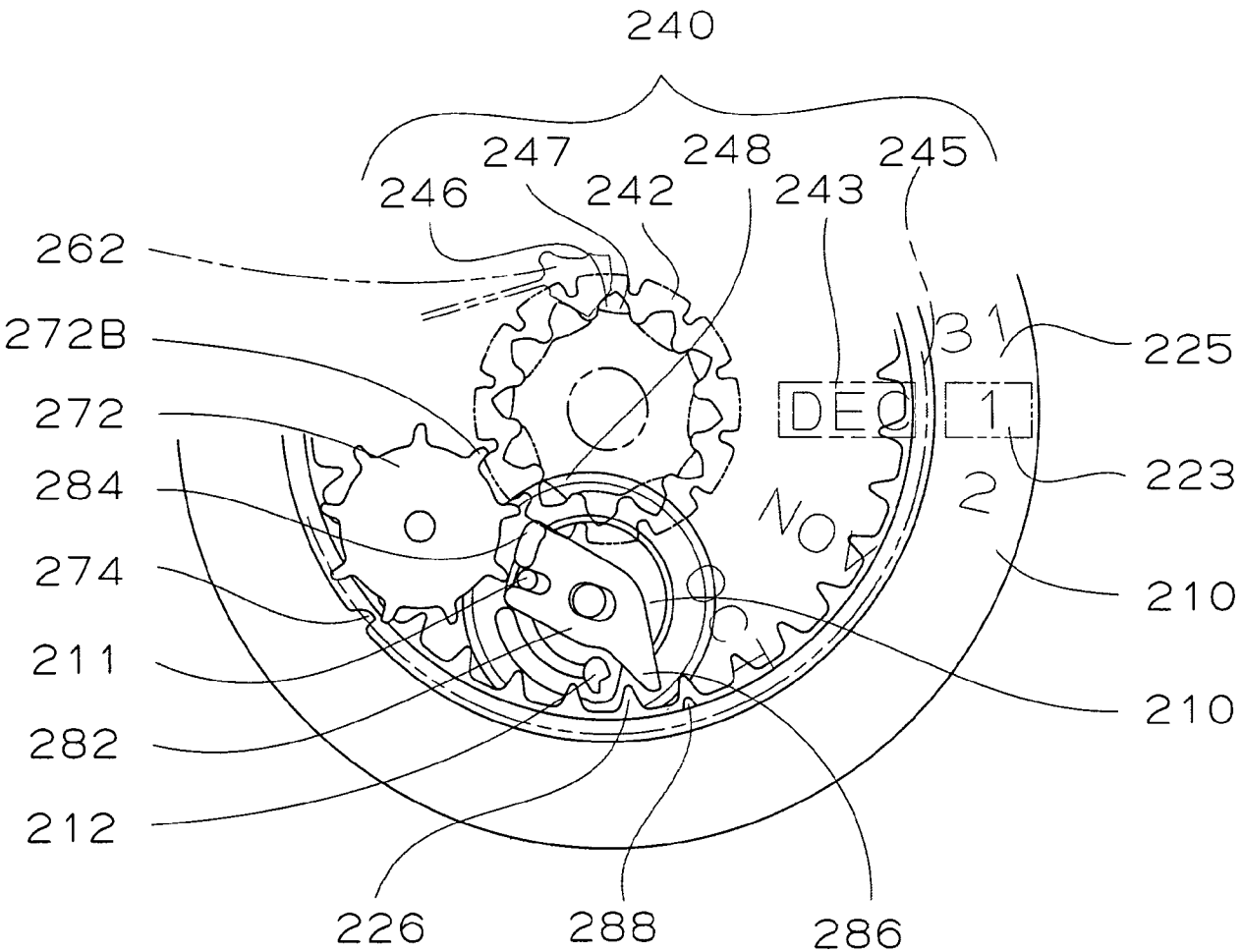
FIG. 18 is a partial plane view (part 6) showing the structures of the date feeding mechanism and the month feeding mechanism in a state of changing from November 30 to December 1 according to the embodiment of the calendar mechanism-attached timepiece of the invention.

In reference to FIG. 18 and FIG. 21, when the date indicator driving wheel 210 is rotated further, the date feed finger 212 is rotated further, and the date indicator tooth portion 226 of the date indicator 220 can be fed by one tooth in the counterclockwise direction. A position in the direction of rotating the date indicator 220 after operation of date feeding is set by the date jumper 260. On the other hand, the month feed tooth 274 of the date indicator 220 can rotate the intermediate month wheel 272 and the intermediate month wheel 272 can feed the month star wheel tooth portion 246 of the month star wheel 247 by one tooth in the clockwise direction. A position in a direction of rotating the month indicator 230 after the operation of month feeding is set by the month jumper 262. As a result, the indication of date is moved from '31' in correspondence with '31-th date' to '1' in correspondence with '1-th date', and the indication of month is moved from 'NOV' in correspondence with 'November' to 'DEC' in correspondence with 'December'.

An operation at a month end of 'small month' other than 'November' is similar to the operation at the month end of 'November'. Further, an operation at a month end of 'February' is similar to the operation at the month end of 'November', and therefore, at the month end of 'February' (February 28 or February 29 in leap year), it is necessary to correct a date such that the indication of date becomes '1' in correspondence with '1-th date' by using the calendar correcting mechanism aforementioned.

(7) Constitution of Mechanical Timepiece:

Although a constitution of applying the calendar mechanism-attached timepiece of the invention to the analog electronic timepiece has been described above, the invention is applicable also to a mechanical timepiece. In a case of constituting the invention by the mechanical timepiece, structures of and operations of a switching mechanism, a calendar feed mechanism, and a calendar correcting mechanism are similar to the structure and operation of the embodiment of the invention mentioned above. Although details of a structure is not illustrated, in the mechanical timepiece, a fourth wheel & pinion is rotated by 1 rotation per 1 minute by rotation of a barrel wheel of a barrel complete by way of rotation of a center wheel & pinion, a third wheel & pinion. A rotational speed of the fourth wheel & pinion is controlled by an escape wheel & pinion. A rotational speed of the escape wheel & pinion is controlled by a pallet fork. A pivoting movement of the pallet fork is controlled by a balance with hairspring. By rotation of the third wheel & pinion, the center wheel & pinion is rotated by 1 rotation per 1 hour. By rotation of the center wheel & pinion, an hour wheel is constituted to rotate by 1 rotation per 12 hours by way of rotation of a minute wheel. A date indicator driving wheel is rotated by rotating the hour wheel.

That is, on a back side of a movement of the mechanical timepiece, by constituting to rotate the date indicator driving wheel by rotation of the hour wheel, a date feeding mechanism and a month feeding mechanism can be operated. It is preferable in the constitution of the mechanical timepiece to arrange the date indicator driving wheel and a small month end feed lever so as not to overlap the barrel complete. By the constitution, a calendar mechanism-attached mechanical timepiece having a thin thickness of the movement can be fabricated.

By the invention, the calendar mechanism-attached timepiece having the thin thickness of the movement can be fabricated by constituting the date feeding mechanism and the month feeding mechanism to be thin. Further, by the invention, the calendar mechanism-attached timepiece stabilizing operation of the date feeding mechanism and the month feeding mechanism can be fabricated. Further, by the invention, the calendar mechanism-attached timepiece constituted such that an extraneous load is not applied to a transmission train wheel in normal date feeding can be fabricated.

What is claimed is:

1. A calendar mechanism-attached timepiece characterized in a calendar mechanism-attached timepiece having a month indicator and a date indicator, the calendar mechanism-attached timepiece comprising:

a date indicator for indicating a date;

a month indicator for indicating a month by being rotated based on rotation of the date indicator;

a date indicator driving wheel constituted to rotate by one rotation per 24 hours;

a date feed finger constituted to be able to rotate the date indicator based on rotation of the date indicator driving wheel; and a small month end feed lever constituted to be able to rotate the date indicator based on rotation of the date indicator driving wheel and rotation of the month indicator;

wherein the date indicator is constituted to include a date indicating face portion provided with a date character, a date indicator tooth portion brought into contact with a date feed portion of the date feed finger, a month feed tooth for rotating an intermediate month wheel, and a small month end feed tooth for feeding the date indicator at an end of a small month;

wherein the month indicator is constituted to include a month indicating face portion provided with a month character, and a month cam for operating the small month end feed lever at the end of the small month;

wherein the small month end feed tooth of the date indicator is arranged to be able to be brought into contact with the small month end feed lever when an indication by the date character is an end of a month; and wherein the small month end feed lever is constituted to be able to feed the date indicator by an amount of one day based on rotation of the date indicator driving wheel and rotation of the month cam at the end of the small month.

2. A calendar mechanism-attached timepiece according to claim 1, further comprising:

the intermediate month wheel constituted to be able to rotate the month indicator by being rotated based on rotation of the date indicator;

wherein the intermediate month wheel is constituted to be able to feed the month indicator at the end of the month.

3. A calendar mechanism-attached timepiece according to claim 1, wherein the small month end feed lever includes a month end feed finger for feeding the date indicator at the end of the small month, the small month end feed tooth is provided to detect time at which an indication of the date indicator is '30-th date', the small month end feed tooth is provided at an inner side wall portion of the date indicator, and the small month end feed tooth of the date indicator is arranged to be able to be brought into contact with the small month end feed finger when the indication by the date character is the end of the month.

4. A calendar mechanism-attached timepiece according to claim 1, wherein the small month end feed lever is arranged on an upper side of the date indicator driving wheel and is constituted to be able to move relative to a rotation center of the date indicator driving wheel.

5. A calendar mechanism-attached timepiece according to claim 1, wherein the small month end feed tooth is arranged on a side more proximate to the date indicator tooth portion than the date indicating face portion.

6. A calendar mechanism-attached timepiece according to claim 1, wherein the date indicator driving wheel includes a lever drive pin, and the small month end feed lever is rotated by the lever drive pin and is constituted to be able to move relative to the small month end feed tooth based on rotation of the month indicator.

* * * * *